US007950758B2

(12) United States Patent
Yoshida

(10) Patent No.: US 7,950,758 B2
(45) Date of Patent: May 31, 2011

(54) LIQUID DISCHARGE APPARATUS AND IMAGE FORMING APPARATUS

(75) Inventor: Takahiro Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 568 days.

(21) Appl. No.: 11/996,035

(22) PCT Filed: May 2, 2007

(86) PCT No.: PCT/JP2007/059807

§ 371 (c)(1),
(2), (4) Date: Jan. 17, 2008

(87) PCT Pub. No.: WO2007/135876

PCT Pub. Date: Nov. 29, 2007

(65) Prior Publication Data

US 2009/0147034 A1 Jun. 11, 2009

(30) Foreign Application Priority Data

May 24, 2006 (JP) ..... 2006-144538
Feb. 19, 2007 (JP) ..... 2007-038598

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS 4,513,299 A * 4/1985 Lee et al. ..... 347/15
5,124,716 A * 6/1992 Roy et al. ..... 347/11
5,146,236 A * 9/1992 Hirata et al. ..... 347/12
6,257,689 B1 * 7/2001 Yonekubo ..... 347/11
6,290,315 B1 * 9/2001 Sayama ..... 347/10
6,328,395 B1 * 12/2001 Kitahara et al. ..... 347/9
6,331,040 B1 * 12/2001 Yonekubo et al. ..... 347/15

(Continued)

FOREIGN PATENT DOCUMENTS

CN 1754697 A 4/2006

(Continued)

OTHER PUBLICATIONS

Aug. 12, 2009 Korean official action in connection with a counterpart Korean patent application No. 10-2008-7001972.

(Continued)

*Primary Examiner* — Matthew Luu
*Assistant Examiner* — Justin Seo
(74) *Attorney, Agent, or Firm* — Cooper & Dunham LLP

(57) ABSTRACT

A liquid discharge apparatus is disclosed that includes a liquid discharge head that discharges plural types of liquid droplets; a drive waveform generating unit that generates and outputs a drive waveform including a first drive signal group made up of one or more drive signals and a second drive signal group made up of one or more drive signals within one drive period; a control signal output unit that outputs first control signals for controlling selection of the drive signals of the first drive signal group and second control signals for controlling selection of the drive signals of the second drive signal group; and a drive unit that inputs the drive waveform, the first control signals, and the second control signals, selects one or more drive signals from the drive signals of the first drive signal group and the second drive signal group using the first control signals and the second control signals, and supplies the selected drive signals to the liquid discharge head.

11 Claims, 18 Drawing Sheets

U.S. PATENT DOCUMENTS

| | | | | |
|---|---|---|---|---|
| 6,371,587 | B1 * | 4/2002 | Chang | 347/11 |
| 2002/0158926 | A1 * | 10/2002 | Fukano | 347/11 |
| 2003/0011653 | A1 * | 1/2003 | Oikawa et al. | 347/15 |
| 2003/0071138 | A1 * | 4/2003 | Usuda | 239/101 |
| 2005/0116883 | A1 * | 6/2005 | Kondoh | 345/10 |
| 2006/0071961 | A1 | 4/2006 | Tamura | |
| 2007/0211092 | A1 * | 9/2007 | Shingyohuchi et al. | 347/10 |

FOREIGN PATENT DOCUMENTS

| | | |
|---|---|---|
| JP | 10-129010 | 5/1998 |
| JP | 11-207947 | 8/1999 |
| JP | 2000-85158 | 3/2000 |
| JP | 2002-211011 | 7/2002 |
| JP | 2002-321394 | 11/2002 |
| JP | 2005-41039 | 2/2005 |
| JP | 3648598 | 2/2005 |
| JP | 2006-247840 | 9/2006 |
| KR | 2005-52984 | 6/2005 |

OTHER PUBLICATIONS

Sep. 18, 2009 Chinese official action (and English translation thereof) in connection with a counterpart Chinese patent application No. 200780000751.1.

* cited by examiner

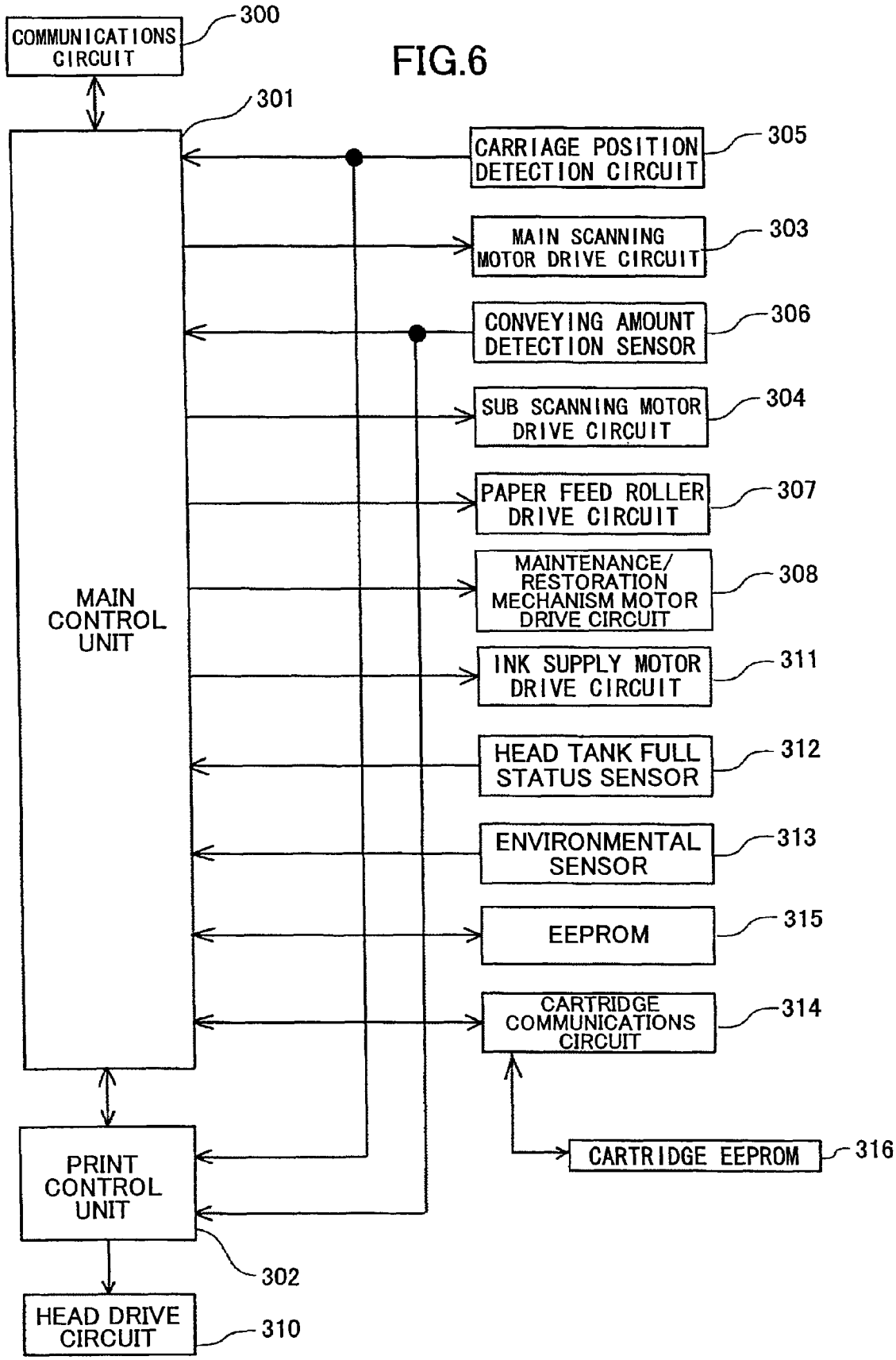
FIG.6
COMMUNICATIONS CIRCUIT
300
301
MAIN CONTROL UNIT
CARRIAGE POSITION DETECTION CIRCUIT
305
MAIN SCANNING MOTOR DRIVE CIRCUIT
303
CONVEYING AMOUNT DETECTION SENSOR
306
SUB SCANNING MOTOR DRIVE CIRCUIT
304
PAPER FEED ROLLER DRIVE CIRCUIT
307
MAINTENANCE/ RESTORATION MECHANISM MOTOR DRIVE CIRCUIT
308
INK SUPPLY MOTOR DRIVE CIRCUIT
311
HEAD TANK FULL STATUS SENSOR
312
ENVIRONMENTAL SENSOR
313
EEPROM
315
CARTRIDGE COMMUNICATIONS CIRCUIT
314
CARTRIDGE EEPROM
316
PRINT CONTROL UNIT
302
HEAD DRIVE CIRCUIT
310

FIG.9

| FIRST MN SIGNAL (SELECTION DRIVE SIGNAL) | SECOND MN SIGNAL (SELECTION DRIVE SIGNAL) | LIQUID DISCHARGE AMOUNT |
|---|---|---|
| MN0a(P1) | MN0b(NONE) | 0pl |
| MN2a(P3) | MN0b(NONE) | 3pl |
| MN0a(P1) | MN1b(P4) | 4pl |
| MN0a(P1) | MN2b(P5) | 5pl |
| MN1a(P2) | MN1b(P4) | 9pl |
| MN3a(P2,P3) | MN1b(P4) | 13pl |
| MN3a(P2,P3) | MN3b(P4,P5) | 18pl |

FIG.10

| MN SIGNAL (SELECTION DRIVE SIGNAL) | LIQUID DISCHARGE AMOUNT |
|---|---|
| MN0(P1) | 0pl |
| MN1(P3) | 3pl |
| MN2(P2,P4) | 9pl |
| MN3(P2,P3,P4,P5) | 18pl |

FIG.12

| FIRST MN SIGNAL (SELECTION DRIVE SIGNAL) | SECOND MN SIGNAL (SELECTION DRIVE SIGNAL) | LIQUID DISCHARGE AMOUNT |
|---|---|---|
| MN10a(NONE) | MN10b(P14) | 0pl |
| MN12a(P12) | MN10b(P14) | 3pl |
| MN10a(NONE) | MN11b(P13) | 4pl |
| MN11a(P11) | MN11b(P13) | 9pl |
| MN13a(P11,12) | MN11b(P13) | 13pl |
| MN11a(P11) | MN12b(P13,P15) | 15pl |
| MN13a(P11,P12) | MN12b(P13,P15) | 18pl |
| MN13a(P11,P12) | MN13b(P13,P14,P15) | 21pl |

FIG.13

| MN SIGNAL (SELECTION DRIVE SIGNAL) | LIQUID DISCHARGE AMOUNT |
|---|---|
| MN10(P14) | 0pl |
| MN11(P12) | 3pl |
| MN12(P11) | 9pl |
| MN13(P11～P15) | 21pl |

FIG.18

| FIRST MN SIGNAL (SELECTION DRIVE SIGNAL) | SECOND MN SIGNAL (SELECTION DRIVE SIGNAL) | LIQUID DISCHARGE AMOUNT |
|---|---|---|
| MN0a'(P1) | MN0b'(NONE) | 0pl |
| MN1a'(P3) | MN0b'(NONE) | 3pl |
| MN0a'(P1) | MN2b'(P4) | 5pl |
| MN2a'(P2) | MN2b'(P4) | 9pl |
| MN2a'(P2) | MN3b'(P4,P5) | 13pl |
| MN3a'(P1,P2,P3) | MN2b'(P4) | 18pl |
| MN3a'(P1,P2,P3) | MN3b'(P4,P5) | 21pl |
| MN0a'(P1) | MN1b'(P6) | LESS THAN 2pl |

FIG.20

| FIRST MN SIGNAL (SELECTION DRIVE SIGNAL) | SECOND MN SIGNAL (SELECTION DRIVE SIGNAL) | LIQUID DISCHARGE AMOUNT |
|---|---|---|
| MN0a"(P1) | MN0b"(NONE) | 0pl |
| MN1a"(P3) | MN0b"(NONE) | 3pl |
| MN2a"(P2,P4) | MN0b"(NONE) | 9pl |
| MN3a"(P2,P3,P4,P5) | MN0b"(NONE) | 21pl |
| MN0a"(P1) | MN3b"(P6) | LESS THAN 2pl |

LIQUID DISCHARGE APPARATUS AND IMAGE FORMING APPARATUS

TECHNICAL FIELD

The present invention relates to a liquid discharge apparatus that includes a liquid discharge head and an image forming apparatus.

BACKGROUND ART

An image forming apparatus such as a printer, a facsimile machine, a copier, or a multifunction machine may use a liquid discharge apparatus that includes a recording head with liquid discharge heads that discharge droplets of recording liquid that are adhered to a medium (also referred to as 'paper' 'recording medium', or 'transfer material' hereinafter) being conveyed within the image forming apparatus to form (record, print) an image on the medium.

It is noted that in the following descriptions, 'image forming apparatus' may refer to any apparatus that is capable of performing image forming operations by discharging liquid onto a medium such as paper, thread, fiber, fabric, leather, metal, plastic, glass, wood, or ceramic material. Also, 'image forming' may refer to generating a meaningful image such as characters or graphic on a medium as well as generating a meaningless image such as a pattern on a medium, for example. Also, 'liquid' used by the liquid discharge apparatus is not limited to ink or a recording liquid and may be any type of fluid that is discharged by a liquid discharge apparatus. Also, 'liquid discharge apparatus' refers to any apparatus that is capable of discharging liquid from a liquid discharge head and is not limited to that used for forming an image.

Various techniques are disclosed for enabling an image forming apparatus including a liquid discharge apparatus with liquid discharge heads to perform gray level printing. For example, Japanese Laid-Open Patent Publication No. 2005-041039 discloses an image forming apparatus that includes a liquid droplet discharge head having a pressure generating chamber that is connected to a nozzle and pressure generating means for contracting and expanding the pressure generating chamber, and drive signal generating means for generating plural drive pulses within one printing period, wherein the plural drive pulses generated within one printing period are selectively supplied to the liquid discharge head so that liquid droplets of differing sizes may be discharged.

Japanese Laid-Open Patent Publication No. 10-129010 discloses a multi-level multiplex inkjet recording apparatus that uses plural inks of the same color with differing concentrations.

Japanese Laid-Open Patent Publication No. 11-207947 discloses a printing apparatus that uses a head that records at least two types of dots with differing dot diameters in a manner such that a dot with a larger diameter of the differing types of dots is recorded at a first position, which is determined based on a relative positioning with respect to a printing object, and a dot with a smaller diameter of the differing types of dots is recorded at a second position that is different from the first position.

Japanese Patent No. 3648598 and Japanese Laid-Open Patent Publication No. 2002-321394 also disclose related techniques for enabling gray level printing.

However, in the case of using a liquid discharge head that discharges inks of the same color with differing concentrations (Japanese Laid-Open Patent Publication No. 10-129010) or a liquid discharge head having nozzles that discharge liquid droplets of differing sizes (Japanese Laid-Open Patent Publication No. 11-207947), cost of the liquid discharge head may be increased.

In this respect, the technique as is disclosed in Japanese Laid-Open Patent Publication No. 2005-041039 may be preferable which involves generating and outputting a drive waveform including plural drive signals within one drive period (one printing period), selectively supplying the drive signals to the liquid discharge head to enable the liquid discharge head to discharge liquid droplets of different sizes/quantities, and combining plural droplets or applying plural droplets on the same position to form dots of different sizes.

It is noted that there is a growing demand for increasing the liquid amount adjustment range for forming liquid droplets in a variety of sizes in the image forming apparatus. Specifically, generation of a larger droplet is in demand for forming a solid image and generation of a smaller droplet is in demand for increasing the image resolution.

In this respect, the bit number of the signal for selecting drive signals of the drive waveform may be increased to increase the number of combinations of drive signals that may be selected, for example. However, in this case, the number of signal lines has to be increased as well so that the configuration of the liquid discharge head may become complicated, for example.

BRIEF SUMMARY

In an aspect of this disclosure, there is provided a liquid discharge apparatus that is capable of discharging a liquid droplet in a wider range of sizes with a simple configuration, and an image forming apparatus including such a liquid discharge apparatus that is capable of forming a high quality image.

According to another aspect, a liquid discharge apparatus is provided that includes:

a liquid discharge head configured to discharge plural types of liquid droplets;

a drive waveform generating unit configured to generate and output a drive waveform including a first drive signal group made up of one or more drive signals and a second drive signal group made up of one or more drive signals within one drive period;

a control signal output unit that outputs first control signals for controlling selection of the drive signals of the first drive signal group and second control signals for controlling selection of the drive signals of the second drive signal group; and a drive unit that inputs the drive waveform, the first control signals, and the second control signals, selects one or more drive signals from the drive signals of the first drive signal group and the second drive signal group using the first control signals and the second control signals, and supplies the selected drive signals to the liquid discharge head.

According to another aspect, an image forming apparatus is provided that includes the aforementioned liquid discharge apparatus.

BRIEF DESCRIPTION OF THE DRAWINGS

FIG. 6 is a block diagram showing an overall configuration of a control unit of the image forming apparatus;

FIG. 9 is a table illustrating an exemplary relationship between different combinations of droplet control signals, drive pulses to be selected by the droplet control signals, and liquid discharge amounts of liquid droplets to be discharged;

FIG. 10 is a table illustrating an exemplary relationship between droplet control signals of a first comparison example, drive pulses to be selected by the droplet control signals, and liquid discharge amounts of liquid droplets to be discharged;

FIG. 12 is a table illustrating another exemplary relationship between different combinations of droplet control signals, drive pulses to be selected by the droplet control signals, and liquid discharge amounts of liquid droplets to be discharged;

FIG. 13 is a table illustrating an exemplary relationship between droplet control signals of a second comparison example, drive pulses to be selected by the droplet control signals, and liquid discharge amounts of liquid droplets to be discharged;

FIG. 18 is a table illustrating an exemplary relationship between different combinations of droplet control signals, drive pulses to be selected by the droplet control signals, and liquid discharge amounts of liquid droplets to be discharged;

FIG. 20 is a table illustrating another exemplary relationship between different combinations of droplet control signals, drive pulses to be selected by the droplet control signals, and liquid discharge amounts of liquid droplets to be discharged.

BEST MODE FOR CARRYING OUT THE INVENTION

In the following, preferred embodiments of the present invention are described with reference to the accompanying drawings.

Figure 1:
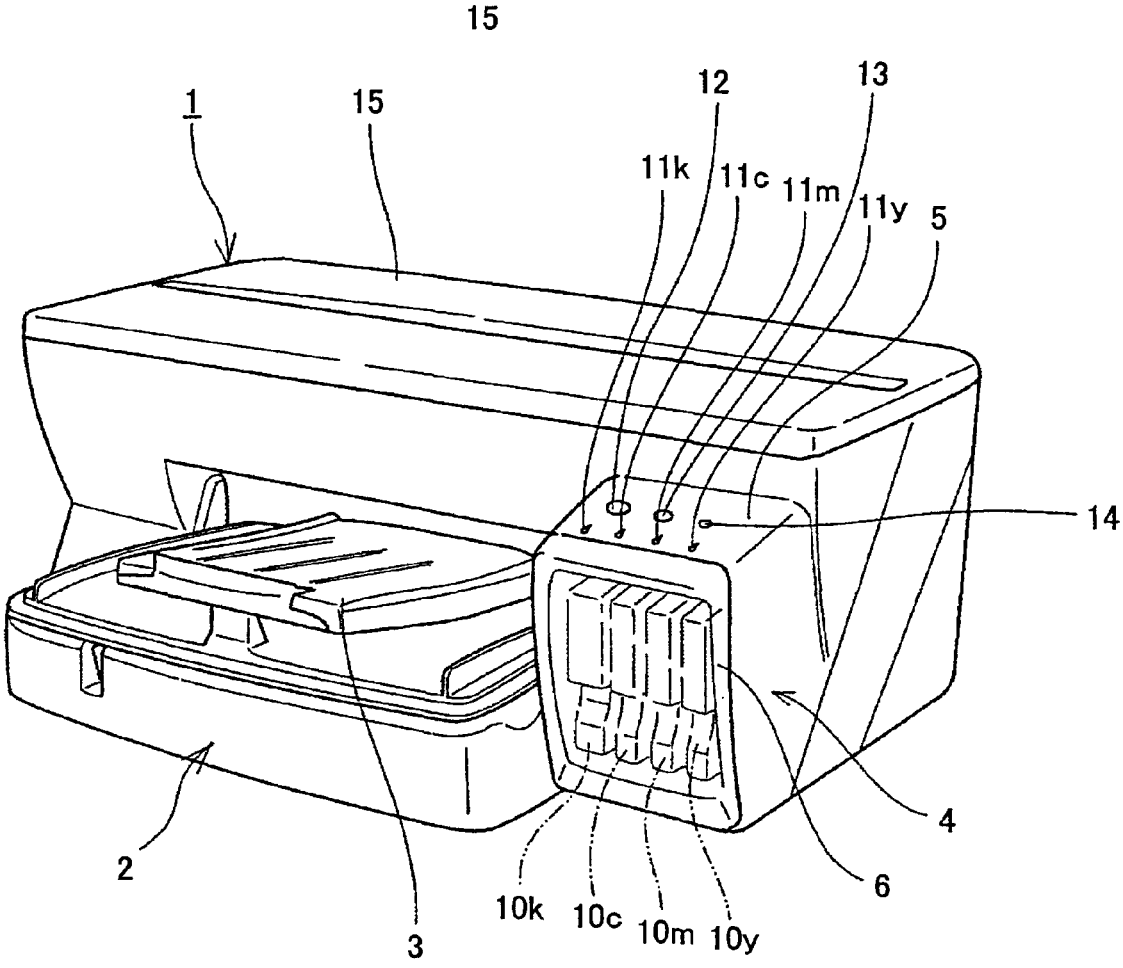
FIG. 1 is a perspective front view of an image forming apparatus according to an embodiment of the present invention.

FIG. 1 is a perspective front view of an image forming apparatus according to an embodiment of the present invention.

The illustrated image forming apparatus of FIG. 1 includes an apparatus main frame 1, a paper feed tray 2 attached to the apparatus main frame 1 for feeding paper to the apparatus, and a paper delivery tray 3 detachably mounted to the apparatus main frame 1 for stocking paper having an image formed thereon. Also, a cartridge loading unit 4 for loading ink cartridges is arranged at one side of the front face of the apparatus main frame 1 (lateral side of the paper feed tray 2 and the paper delivery tray 3). The cartridge loading unit 4 protrudes forward from the front face of the apparatus main frame 1 and has an upper face that is positioned lower than that of the apparatus main frame 1. Also, an operation/indication unit 5 including operation buttons and indication units is arranged on the upper face of the cartridge loading unit 4.

The cartridge loading unit 4 is configured to accommodate plural recording liquid cartridges containing recording liquids (inks) of different colors such as ink cartridges 10*k*, 10*c*, 10*m*, and 10*y* (simply referred to as 'ink cartridge 10' when color distinctions are not made) containing black (K) ink, cyan (C) ink, magenta (M) ink, and yellow (Y) ink, respectively. The ink cartridges 10 may be inserted into the cartridge loading unit 4 from the front side of the apparatus main frame 1. The front face of the cartridge loading unit 4 may be covered by a front cover (cartridge cover) 6, which may be opened upon loading/unloading the ink cartridges 10.

The operation/indication unit 5 includes remaining liquid amount indication units 11*k*, 11*c*, 11*m*, and 11*y* for signaling a liquid near end status and a liquid end status of the ink cartridges 10*k*, 10*c*, 10*m*, and 10*y*, respectively. The remaining liquid amount indication units 11*k*, 11*c*, 11*m*, and 11*y* are arranged at positions corresponding to the loading positions of the ink cartridges 10*k*, 10*c*, 10*m*, and 10*y*, respectively. The operation/indication unit 5 also includes a power button 12, a paper conveying/print resuming button 13, and a cancel button 14, for example.

Figure 2:
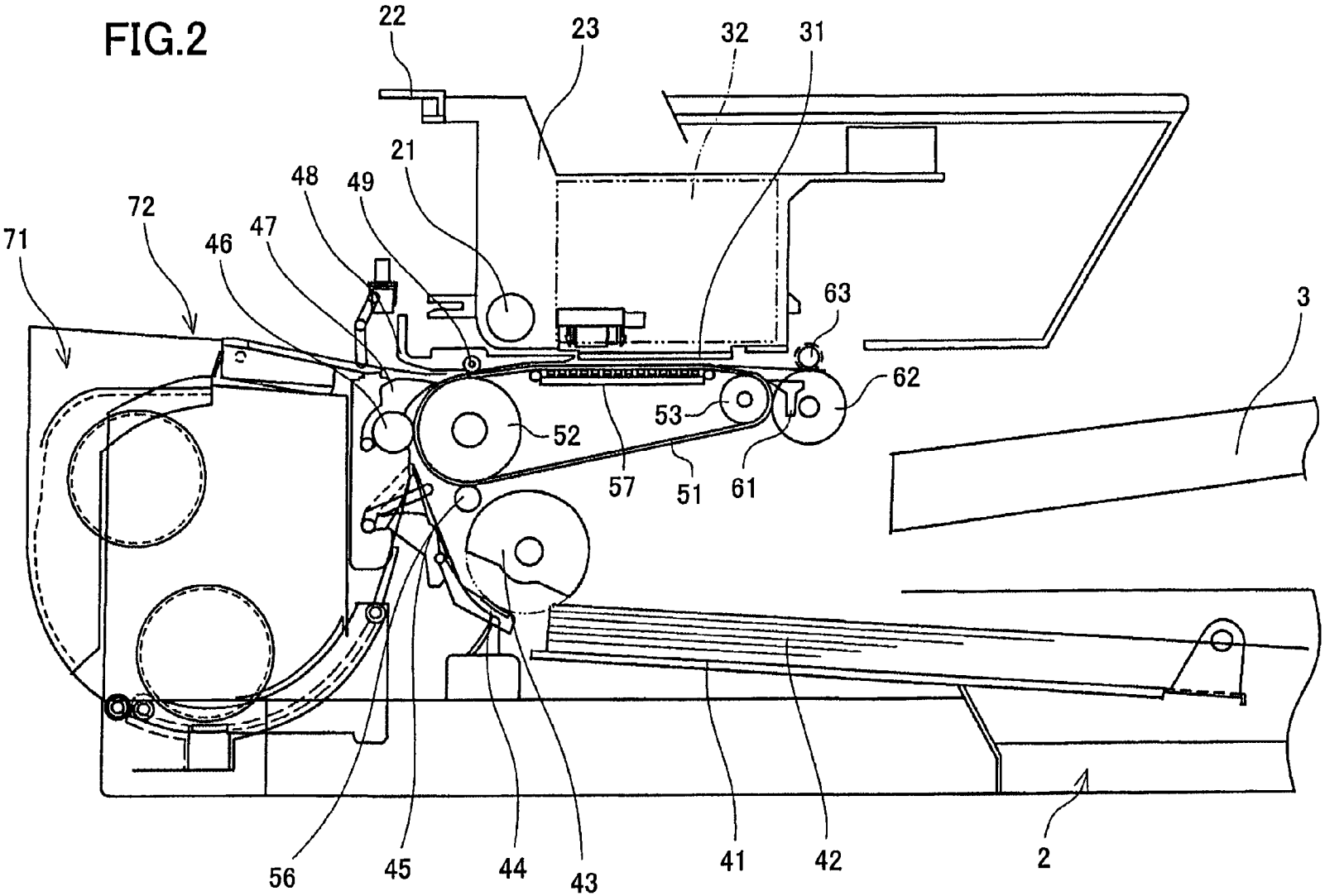
FIG. 2 is a diagram showing a mechanical structure of the image forming apparatus shown in FIG. 1.

In the following, a mechanical structure of the image forming apparatus of the present embodiment is described with reference to FIGS. 2 and 3. It is noted that FIG. 2 is a diagram showing the overall mechanical structure of the image forming apparatus, and FIG. 3 is a plan view showing a relevant part of the mechanical structure.

Figure 3:
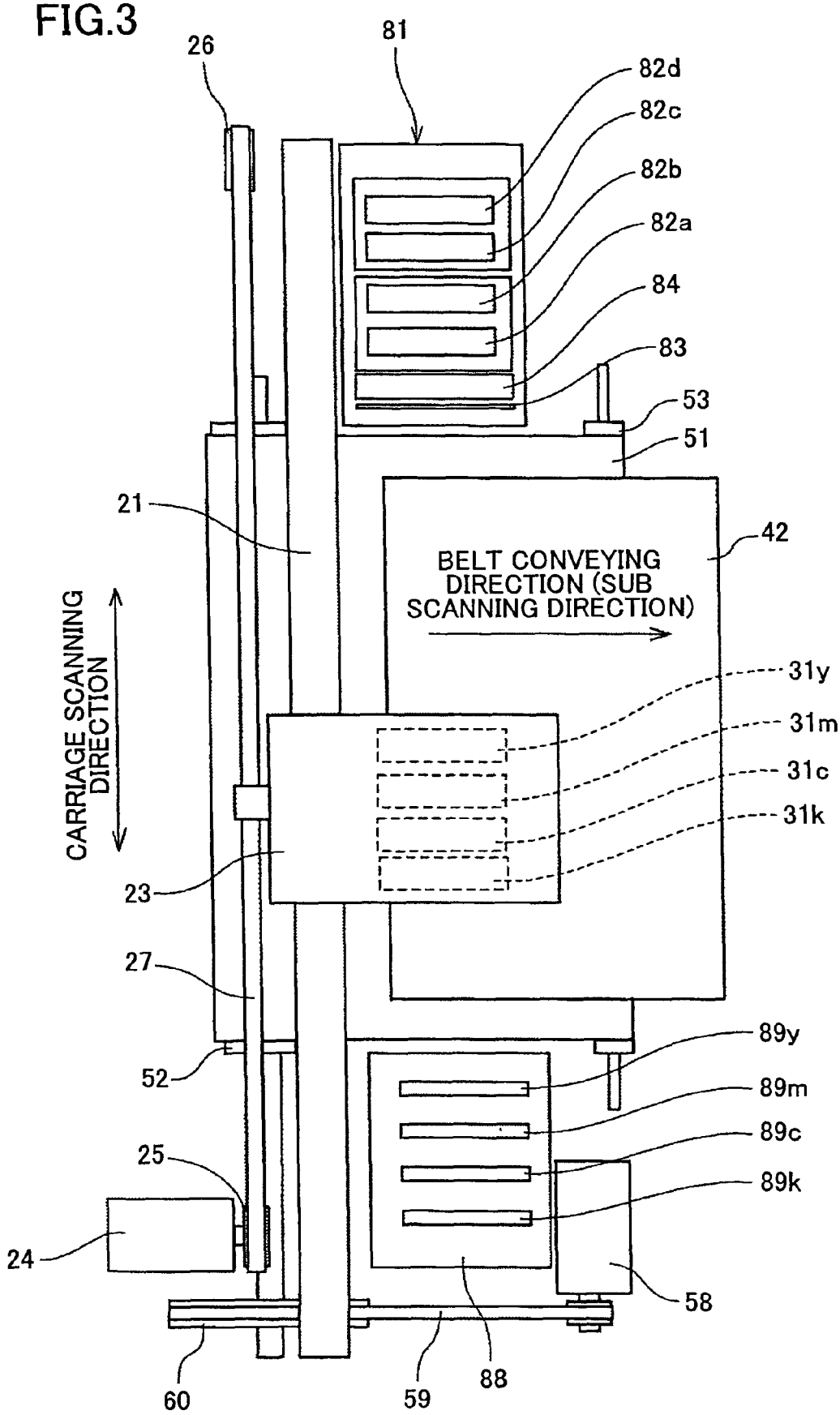
FIG. 3 is a plan view of a relevant part of the mechanical structure shown in FIG. 2.

As is illustrated in these drawings, a carriage 23 is supported by a guide member including a guide rod 21 and a stay 22 that extend laterally between left and right side boards (not shown) so that the carriage 23 may freely slide in main scanning directions (carriage scanning directions) shown in FIG. 3. The carriage 23 may be moved in the main scanning directions by a main scanning motor 24 via a timing belt 27 that is arranged around a drive pulley 25 and a driven pulley 26.

The carriage 23 includes recording heads 31*k*, 31*c*, 31*m*, and 31*y* that correspond to liquid discharge heads that discharge ink droplets of the colors yellow (Y), cyan (C), magenta (M), and black (Bk), respectively (simply referred to as 'recording head 31' when color distinctions are not made). The recording head 31 has plural ink spouts (nozzles) aligned in directions intersecting the main scanning directions, and is mounted on the carriage 23 in a manner such that the ink droplet discharge direction is directed downward.

In certain embodiments, the recording head 31 may be an inkjet head that includes a piezoelectric actuator such as a piezoelectric element, a thermal actuator that uses phase change induced by film boiling of liquid by a thermoelectric conversion element such as a heat element, a shape memory alloy actuator that uses metal phase change induced by temperature change, or an electrostatic actuator that uses electrostatic force, for example, as pressure generating means for generating pressure for discharging liquid. It is noted that the inkjet head has plural nozzles that are arranged into plural nozzle rows where the nozzle rows may either discharge liquid droplets of the same color or liquid droplets in different colors.

The carriage 23 also includes head tanks 32 for supplying corresponding color inks to the recording heads 31. The head tanks 32 may receive corresponding color inks from the ink cartridges 10 loaded in the cartridge loading unit 4 via ink supply tubes, for example.

Also, as is shown in FIG. 2, a paper feed unit for feeding paper 42 stacked on a paper stacking unit (pressure plate) 41 of the paper feed tray 2 is provided, the paper feed unit including a paper feed roller 43 that separates one sheet of paper from the paper 42 stacked on the paper stacking unit 41 and a separating pad 44 made of a material with a large friction coefficient that is arranged opposite the paper feed roller 43 and is biased toward the paper feed roller 43.

Also, a guide member 45 that guides the paper 42 fed by the paper feed unit, a counter roller 46, a conveying guide member 47, and a press member 48 including a tip pressurizing roller 49 are provided for conveying the paper 42 fed by the feed unit toward the recording heads 31. Further, a conveying belt 51 that attracts the paper 42 by electrostatic force and conveys the paper 42 to a position opposing the recording heads 31 is provided.

The conveying belt 51 is an endless belt that is arranged around a conveying roller 52 and a tension roller 53 and is configured to rotate in a belt conveying direction (sub scanning direction) shown in FIG. 3. In one embodiment, the conveying belt 51 may include a surface layer corresponding to a paper attracting surface that is made of pure resin material such as pure ETFE material having a thickness of approximately 40 μm that is not rheostatically controlled and a back layer (mid resistance layer, earth layer) that is made of the same material as the surface layer but is rheostatically controlled by carbon.

Also, a charge roller 56 is provided for charging the surface of the conveying belt 51. The charge roller 56 is arranged to come into contact with the surface layer of the conveying belt 51 to be driven and rotated by the rotating movement of the conveying belt 51. A predetermined pressure is applied as a pressurizing force to both shaft ends of the charge roller 56. In one embodiment, the conveying roller 52 may also function as an earth roller that comes into contact with the mid resistance layer (back layer) and is connected to ground.

Also, a guide member 57 is arranged on the inner side of the conveying belt 51 at a position corresponding to the printing area of the recording heads 31. The guide member 57 has an upper face that is thrust toward the recording head 31 side past the tangent line of the two rollers (conveying roller 52 and tension roller 53) supporting the conveying belt 51 so that planarity of the conveying belt 51 may be accurately maintained.

The conveying roller 52 is driven and rotated by a sub scanning motor 58 via a drive belt 59 and a pulley 60, and in turn, the conveying belt 51 moves in the belt conveying direction (sub scanning direction) as is shown in FIG. 3.

Also, a paper delivery unit is provided for delivering paper 42 having an image recorded thereon by the recording heads 31, the paper delivery unit including a separating piece 61 for separating the recorded paper 42 from the conveying belt 51, a paper delivery roller 62, and a paper delivery wheel 63. The paper delivery tray 3 is arranged below the paper delivery roller 62 to receive the delivered paper 42.

Also, a dual side printing unit 71 is detachably mounted at the rear side of the apparatus main frame 1. The dual side printing unit 71 receives paper 42 that is conveyed backward by the reverse rotational movement of the conveying belt 51, turns the paper 42 over to the other side, and feeds the paper 42 between the counter roller 46 and the conveying belt 51. Further, a manual feed tray 72 is arranged on the upper side of the dual side printing unit 71.

As is shown in FIG. 3, a maintenance/restoration mechanism 81 for maintaining and restoring the nozzles of the recording heads 31 is arranged at a non-printing area on one main scanning direction side of the carriage 23.

The maintenance/restoration mechanism 81 includes caps 82*a*-82*d* for capping the nozzle surfaces of the recording heads (collectively referred to as 'caps 82' hereinafter), a wiper blade 83 for wiping the nozzle surfaces, and an idle discharge receiver 84 that receives liquid droplets discharged from the recording heads 31 during idle discharge operations irrelevant to image recording operations for discharging recording liquid that has become overly viscous. In the present example, it is assumed that the cap 82*a* may be used as a suction/moisture retention cap (referred to as 'suction cap' hereinafter) and the other caps 82*b*-82*d* are simply used as moisture retention caps.

Also, an idle discharge receiver 88 is arranged at a non-printing area on the other main scanning direction side of the carriage 23. The idle discharge receiver 88 receives liquid droplets that are discharged during idle discharge operations irrelevant to recording operations for discharging recording liquid that has become overly viscous. The idle discharge receiver 88 has openings 89*a*-89*d* that extend in the alignment directions of the nozzle rows of the recording heads 31.

In the image forming apparatus (inkjet recording apparatus) as is described above, the paper feed unit separates and feeds paper 42 from the feed tray 2 one sheet at a time, and the paper 42 that is fed upward in a substantially vertical direction is guided by the guide member 45 to be inserted between the conveying belt 51 and the counter roller 46. Then, the tip of the paper 42 is guided by the conveying guide member 47 and pressed onto the conveying belt 51 by the tip pressurizing roller 49 so that the conveying direction of the paper 42 may be turned by approximately 90 degrees.

At this point, an alternating voltage consisting of alternating positive and negative outputs is applied to the charge roller 56 from an AC bias supply unit by a control unit (not shown) so that the conveying belt 51 may be charged by an alternating charge voltage pattern, that is, the conveying belt 51 is alternatingly charged by a positive charge and a negative charge at predetermined width intervals in the sub scanning direction corresponding to the rotating direction of the conveying belt 51. When the paper 42 is conveyed to the conveying belt 51 that is alternatingly charged by the positive and negative charge voltages, the paper 42 is attracted to the conveying belt 51 and the paper 42 is conveyed in the sub scanning direction by the rotational movement of the conveying belt 51.

Then, one line image is recorded on the paper 42 while the paper 42 is held still by moving the carriage 23 and driving the recording heads 31 to discharge ink droplets according to an image signal after which the paper 42 may be moved by a predetermined distance to have the next line image recorded thereon. The recording operations may be ended upon receiving a recording end signal or a signal indicating that the rear end of the paper 42 has reached the recording area after which the paper 42 may be delivered to the discharge tray 3.

Also, during printing (recording) standby mode, the carriage 23 may be moved to the maintenance/restoration mechanism 81 side, and the recording heads 31 may be capped by the caps 82 so that the moistness of the nozzles of the recording heads 31 may be maintained and discharge defects caused by the drying of ink may be prevented. Also, restoration operations may be performed while the recording heads are covered by the caps 82. The restoration operations may involve extracting recording liquid from the nozzles of the recording heads 31 using a suction pump (not shown) (referred to as 'nozzle suction' or 'head suction' hereinafter) so that recording liquid that has become overly viscous or air bubbles generated in the recording liquid may be discharged, for example.

Also, idle discharge operations irrelevant to recording operations for discharging liquid into the idle discharge receivers 84 and 88 may be performed before or during recording operations. In this way, stable discharge performance of the recording heads 31 may be maintained.

In the following, an exemplary configuration of the liquid discharge head of the image forming apparatus according to an embodiment of the present invention is described with reference to FIGS. 4 and 5.

Figure 4:
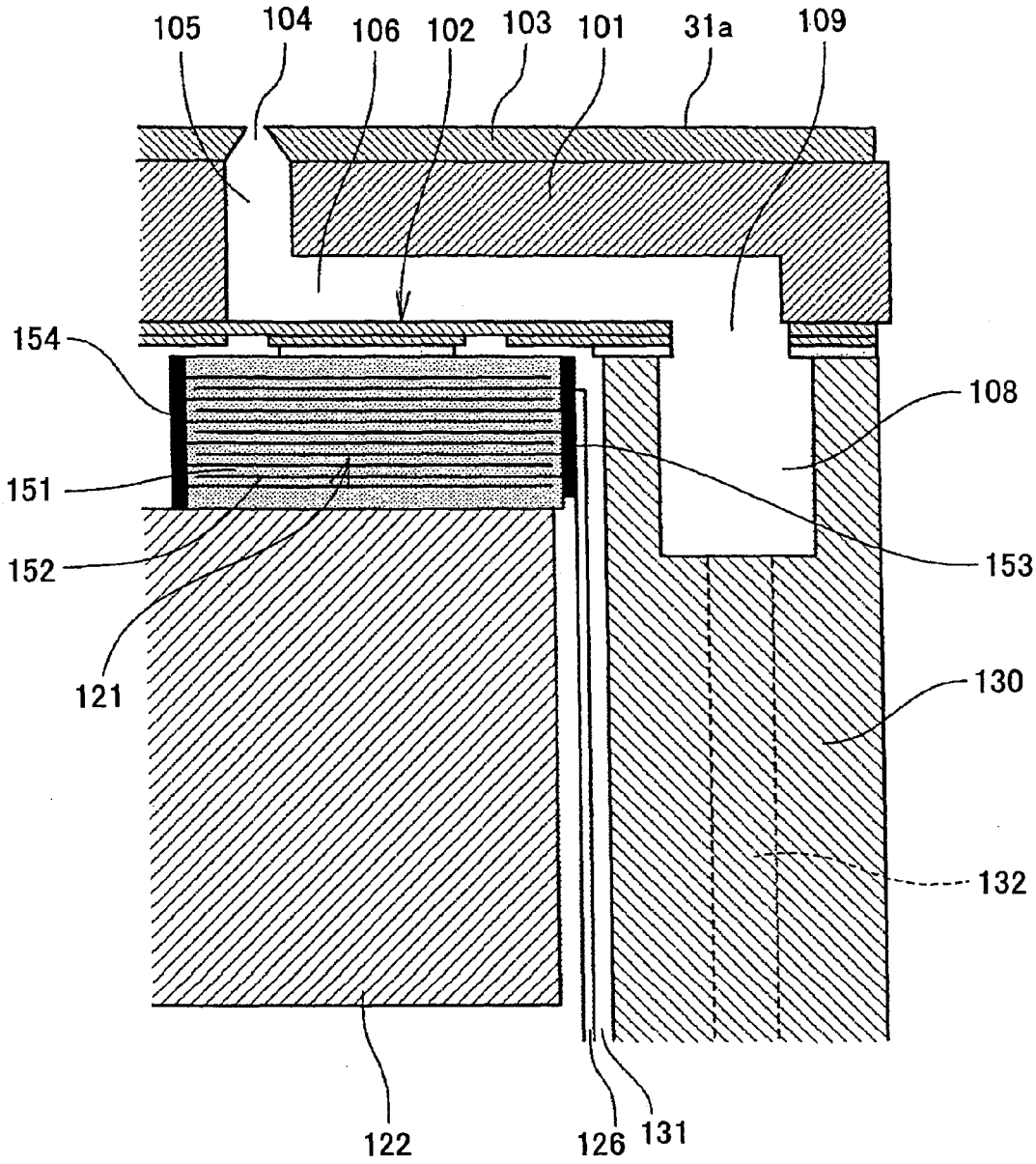
FIG. 4 is a cross-sectional view of a liquid discharge head of the image forming apparatus cut along longer side directions of a liquid chamber.
Figure 5:
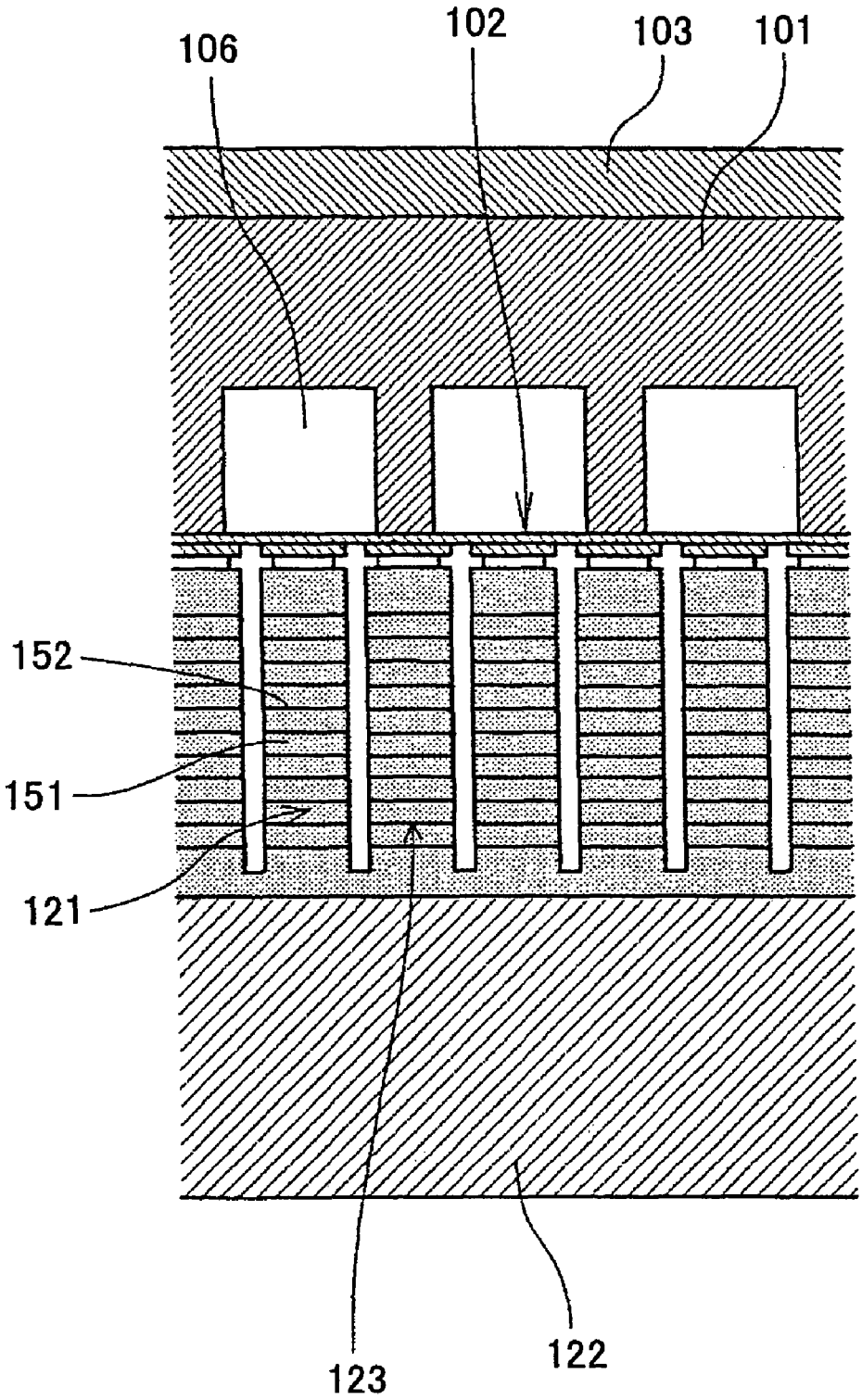
FIG. 5 is a cross-sectional view of a liquid discharge head cut along short side directions of the liquid chamber.

FIG. 4 is a cross-sectional view of the liquid discharge head cut along longer side directions of a liquid chamber, and FIG. 5 is a cross-sectional view of the liquid discharge head cut across short side directions of the liquid chamber (nozzle alignment directions).

The illustrated liquid discharge head has a layered structure including a flow path plate 101 that may be created by etching a SUS substrate or a single crystal silicon substrate, for example, an oscillating plate 102 connected to the lower face of the flow path plate 101 that may be created through nickel electroforming, for example, and a nozzle plate 103 connected to the upper face of the flow path plate 101. By layering the oscillating plate 102, the flow path plate 101, and the nozzle plate 103, a nozzle 104 for discharging liquid droplets (ink droplets), a nozzle connection path 105 that is connected to the nozzle 104, a liquid chamber 106, and an ink supply port 109 that is connected to a common chamber 108 for supplying ink to the liquid chamber 106 may be created.

Also, plural layered piezoelectric elements 121 (only one is shown in FIG. 4) as electro mechanical conversion elements corresponding to pressure generating means (actuator means) for deforming the oscillation plate 102 and applying pressure to the ink contained within the liquid camber 106 and a base substrate 122 that fixes the piezoelectric elements 121 are provided. It is noted that supports 123 are arranged between the piezoelectric elements 121. The supports 123 are created together with the piezoelectric elements by dividing a piezoelectric element material but are not applied a drive voltage so that they merely act as support members.

The piezoelectric element 121 is connected to a FPC cable 126 for establishing connection with a drive circuit (drive IC) (not shown).

A rim portion of the oscillation plate 102 is connected to a frame member 130, which has a through hole portion 131 for accommodating an actuator unit including the piezoelectric elements 121 and the base substrate 122, a concave portion that forms the common liquid chamber 108, and an ink supply hole 132 for supplying ink to the common liquid chamber from the exterior. In certain preferred embodiments, the frame member 130 may be created through injection molding using thermal cure resin such as epoxy resin or polyphenylene sulfide, for example.

The flow path plate 101 may be created by performing anisotropic etching on a single crystal silicon substrate with a crystal orientation of (110) using an alkaline etching solution such as an aqueous potassium hydroxide solution (KOH solution), or etching a SUS substrate to create concave portions and holes that form the nozzle connection path 105 and the liquid chamber 106, for example.

The oscillation plate 102 may be created by performing an electroforming process on a metal plate made of nickel, for example. Alternatively, other types of metal plates or metal/resin plate combinations may be used. It is noted that the piezoelectric elements 121 and supports 123 may be connected to the oscillation plate 102 by adhesive, and the frame member 130 may also be connected to the oscillation plate 102 by adhesive, for example.

The nozzle plate 103 has a nozzle 104 with a diameter of 10-30 μm corresponding to each of plural liquid chambers 106 formed within the liquid discharge head and may be connected to the flow path plate 101 by adhesive, for example. The nozzle plate 103 may be made of a metal nozzle member that has a water-repellent layer applied on its uppermost surface. It is noted that the surface of the nozzle plate 103 becomes a nozzle surface 31*a* of the recording head 31.

The piezoelectric element 121 corresponds to a layered piezoelectric element (e.g., PZT) in which piezoelectric material 151 and internal electrodes 152 are alternatingly layered. The internal electrodes 52 that are drawn to alternating ends of the piezoelectric element 121 are connected to an individual electrode 153 and a common electrode 154. In the present embodiment, the d33 displacement mode is used so that the ink within the liquid chamber 106 may be pressurized by the displacement of the piezoelectric element 121 in the d33 direction. However, the present invention is not limited to such an embodiment, and the d31 displacement mode may also be used to pressurize the ink within the liquid chamber 106 by the displacement of the piezoelectric element 121 in the d31 direction. In another embodiment, one row of the piezoelectric element 121 may be fixed to one substrate 122.

In the liquid discharge head as is described above, the voltage applied to the piezoelectric element 121 may be decreased with respect to a reference potential. In turn, the piezoelectric element 121 may contract and the oscillation plate 102 may be lowered so that the volume of the liquid chamber 106 may increase and ink may flow into the liquid chamber 106, for example. Then, the voltage applied to the piezoelectric element 121 may be increased so that the piezoelectric element 121 may expand in the layering directions (vertical directions in FIGS. 4 and 5). In turn, the oscillating plate 102 may be raised toward the nozzle 104 side and the capacity/volume of the liquid chamber 106 may be reduced so that the recording liquid within the liquid chamber 106 may be pressurized and droplets of the recording liquid may be discharged from the nozzle 104.

Then, the voltage applied to the piezoelectric element 121 may be readjusted to the reference potential so that the oscillating plate 102 may move back to its initial position as a result of which the liquid chamber 106 may expand to generate a negative pressure. In turn, the liquid chamber 106 may be replenished with recording liquid from the common liquid chamber 108. Then, after the oscillation of the meniscus of the recording liquid at the nozzle attenuates and stabilizes, the liquid discharge head may perform a next sequence of liquid discharge operations.

It is noted that in the above-described example, the liquid discharge head is driven by pulling and pushing the oscillating plate 102. However, the drive method for driving the liquid discharge head is not limited to such an example, and other methods may be used depending on the manner in which a drive waveform is supplied, for example.

In the following, a control unit of the image forming apparatus according to the present embodiment is described with reference to FIG. 6.

FIG. 6 is a block diagram showing a configuration of the control unit of the image forming apparatus according to an embodiment of the present invention.

The illustrated control unit controls overall operations of the image forming apparatus of the present embodiment and includes a main control unit 301 that may be a microcomputer with means for controlling idle discharge operations and a print control unit 302 that may be a microcomputer with means for controlling print operations.

The main control unit 301 controls operations for forming an image on paper 42 based on print processing information input thereto from a communications circuit 300. For example, the main control unit 301 controls drive operations for driving the main scanning motor 24 and the sub scanning motor 58 via a main scanning motor drive circuit 303 and a sub scanning motor 304, and transmission operations for transmitting print data to the print control unit 302.

Also, a detection signal from a carriage position detection circuit 305 that detects the position of the carriage 23 is input to the main control unit 301, and the main control unit 301 controls the moving position and moving speed of the carriage 23 based on the input detection signal from the carriage position detection circuit 305. In one embodiment, the carriage position detection circuit 305 may detect the position of the carriage 23 by reading slits of an encoder sheet arranged along the scanning direction of the carriage 23 with a photo sensor that is installed in the carriage 23 and counting the slits read by the photo sensor. The main scanning motor drive circuit 303 drives and rotates the main scanning motor 24 according to information on the carriage moving amount input from the main control unit 301 to move the carriage 23 to a predetermined position at a predetermined speed.

Also, a detection signal from a conveying amount detection circuit 306 that detects the moving amount of the conveying belt 51 is input to the main control unit 301, and the main control unit 301 controls the moving amount and moving speed of the conveying belt 51 based on the input detection signal from the conveying amount detection circuit 306. In one embodiment, the conveying amount detection circuit 306 may detect the conveying amount of the conveying belt 51 by reading slits of a rotating encoder sheet arranged around the rotation shaft of the conveying roller 52 with a photo sensor and counting the slits read by the photo sensor. The sub scanning motor drive unit 304 drives and rotates the sub scanning motor 58 according to information on the conveying amount of the conveying belt 51 input from the main control unit 301 to drive and rotate the conveying roller 52 and move the conveying belt 51 to a predetermined position at a predetermined speed.

The control unit 301 inputs a paper feed roller drive command signal to a paper feed roller drive circuit 307 to turn the paper feed roller 43 around by 360 degrees. Also, the main control unit 301 drives and rotates a motor 221 of the maintenance/restoration mechanism 81 via a maintenance/restoration mechanism drive motor drive circuit 308 to enable raising/lowering operations of the caps 82, the wiper blade 83, and the suction pump, for example.

The main control unit 301 also controls drive operations of an ink supply motor for driving a pump of an ink supply unit via an ink supply motor drive circuit 311 so that ink accommodated in the ink cartridges 10 that are loaded into the cartridge loading unit 4 may be supplied to the head tanks 32. In one embodiment, the main control unit 301 may control such supply operations based on a detection signal from a head tank full status sensor 312 that detects the tank full status of the head tanks 32.

Also, the main control unit 301 acquires information stored in a nonvolatile memory 316 installed in each of the ink cartridges 10 that are loaded into the cartridge loading unit 4 via a cartridge communications circuit 314, performs prescribed processes on the acquired information, and stores the processed information in a nonvolatile memory 315 (such as an EEPROM) that is installed in the apparatus main frame 1.

Also, a detection signal from an environmental sensor 313 that detects the environmental temperature and environmental humidity is input to the main control unit 301.

The print control unit 302 generates data for driving the pressure generating means (actuator means) of the recording heads 31 to enable discharge of liquid droplets based on information including a signal from the main control signal 301, carriage position information from the carriage position detection circuit 305, and the conveying amount information from the conveying amount detection circuit 306, for example. Also, the print control unit 302 transfers image data as serial data to the head drive circuit 310, and outputs signals for enabling or confirming such image data transfer such as a transfer clock signal, a latch signal, and a droplet control signal (mask signal) to the head drive circuit 310. Further, the print control unit 302 has a drive waveform generating unit and a drive waveform selecting unit for generating a drive waveform including plural drive signal groups each made up of one or more drive pulses (drive signals) and outputting the generated waveform to the head drive circuit 310. In one embodiment, the drive waveform generating unit may include a D/A converter that performs D/A conversion on pattern data of a drive signal stored in a ROM and an amplifier such as a voltage amplifier or a current amplifier. The drive waveform selecting unit may select the drive waveform to be supplied to the head drive circuit 310.

The head drive circuit 310 drives the recording heads 31 based on serially input image data corresponding to one line image to be output by the recording heads 31 by selectively applying a drive signal of a drive waveform supplied from the print control unit 302 to a drive element (e.g. piezoelectric element 121 as is described above) that generates energy for discharging liquid droplets from a corresponding recording head 31. In one embodiment, drive pulses (drive signals) of the drive signal groups making up the drive waveform may be selectively applied to the drive element so that droplets of differing sizes may be discharged depending on the selected drive pulse and dots of differing sizes may be formed.

In the following, exemplary configurations of the print control unit 302 and the head drive circuit (head driver) 310 are described with reference to FIG. 7.

Figure 7:
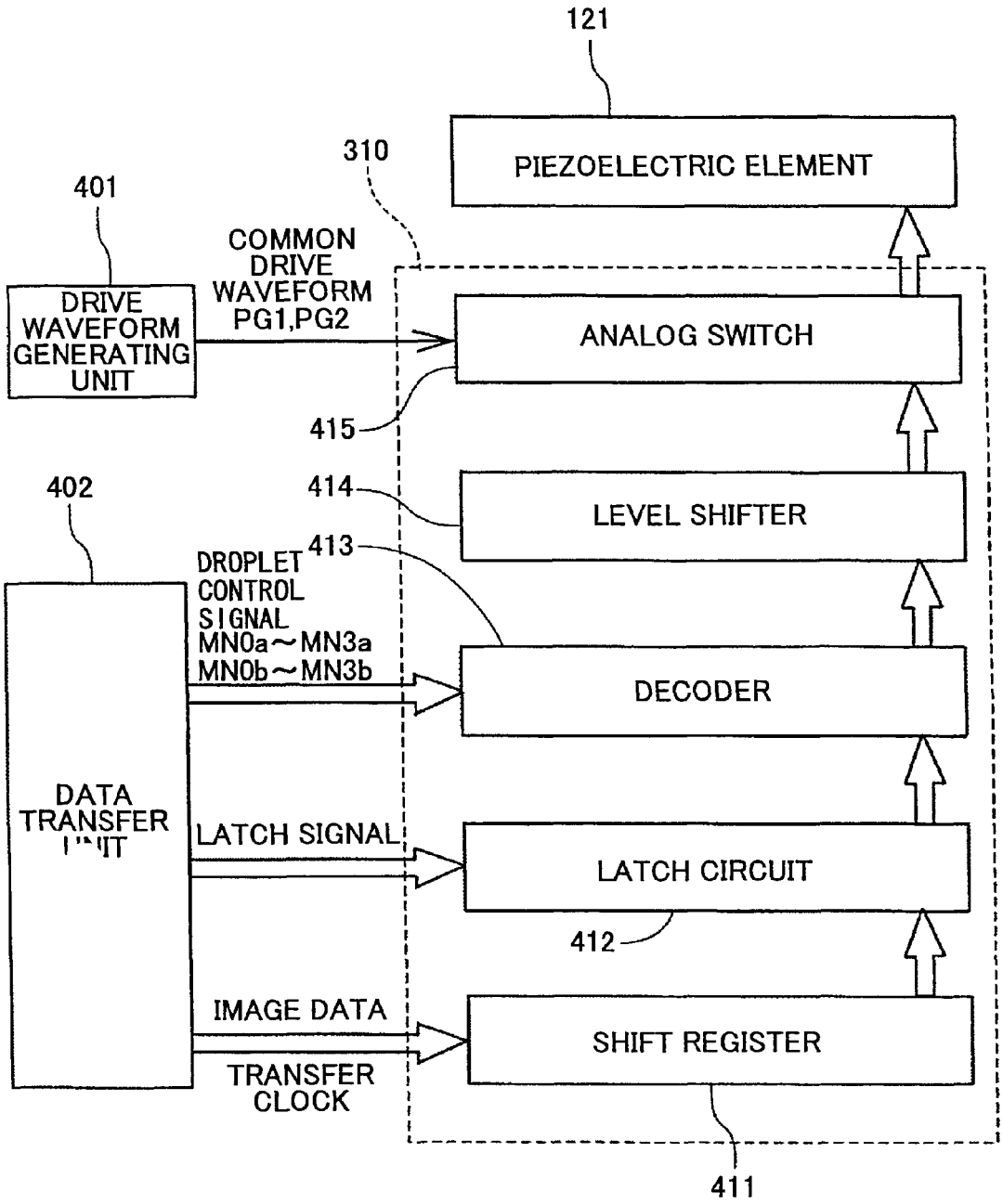
FIG. 7 is a block diagram showing a configuration of a print control unit of the control unit shown in FIG. 6.

In the illustrated example of FIG. 7, the print control unit 302 includes a drive waveform generating unit 401 that generates and outputs a drive waveform (common drive waveform) and a data transfer unit 402 that outputs two-bit image data (gray level signals 0, 1) corresponding to a print image, a clock signal, a latch signal (LAT), and droplet control signals MN0*a*-MN3*a* and MN0*b*-MN3*b*.

In the present example, the drive waveform unit 401, which is also described below in relation to FIG. 8 (*a*), is configured to generate and output a waveform (common waveform)

including a first drive signal group PG1 made up of one or more drive signals (drive pulses) followed by a second drive signal group PG2 made up of one or more drive signals (drive pulses) within one drive period (one printing period). It is noted that although a waveform including two consecutive drive signal groups is generated and output in the present example, the present invention is not limited to such an example and a waveform including three or more drive signal groups may be generated and output in other examples.

The data transfer unit 402 successively outputs first droplet control signals MN0*a*-MN3*a* for selecting drive signals of the first drive signal group PG1 and second droplet control signals MN0*b*-MN3*b* for selecting drive signals of the second drive signal group PG2 within one drive period in accordance with the output of the first drive signal group PG1 and the second drive signal group PG2 by the drive waveform generating unit 401.

In the present example, the first and second droplet control signals MN0*a*-MN3*a* and MN0*b*-MN3*b* correspond to two-bit signals for directing an analog switch 415 of the head drive circuit 310 to open/close. Specifically, the signal statuses of the first and second droplet control signals MN0*a*-MN3*a* and MN0*b*-MN3*b* fluctuate between levels L (for signaling selection of a corresponding drive pulse) and H (for signaling non-selection of a corresponding drive pulse) in accordance with the periods of the first drive signal group PG1 and the second drive signal group PG2.

In the present example, the head drive circuit 310 includes a shift register 411 that inputs a transfer clock (shift clock) and serial image data (gray level data: 2 bits/CH) from the data transfer unit 402, a latch circuit 412 for latching registered values of the shift register 411 with a latch signal, a decoder 413 for decoding the gray level data and the first and second droplet control signals MN0*a*-MN3*a* and MN0*b*-MN3*b* and outputting the decoding results, a level shifter 414 for converting the level of a logic level voltage signal from the decoder 413 to a level operable by an analog switch 415, and the analog switch 415 that turns on/off (opens/closes) according to the output of the decoder 413 that is supplied thereto via the level shifter 414.

The analog switch 415 is connected to the selection electrodes (individual electrodes) 154 (see FIG. 4) of the piezoelectric elements 121, and the common drive waveform from the drive waveform generating unit 401 is input to the analog switch 415. Accordingly, when the analog switch 415 is turned on according to decoding results of decoding the serially transferred image data (gray level data) and the first and second droplet control signals MN0*a*-MN3*a* and MN0*b*-MN3*b* at the decoder 413, relevant drive signals of the drive signals included in the first drive signal group PG1 and the second drive signal group PG2 making up the common drive waveform may pass (be selected) to be applied to the piezoelectric element 121.

In the following, examples of a drive waveform output from the drive waveform generating unit 401 and first and second droplet control signals output by the data transfer unit 402 are described with reference to FIGS. 8 and 9.

Figure 8:
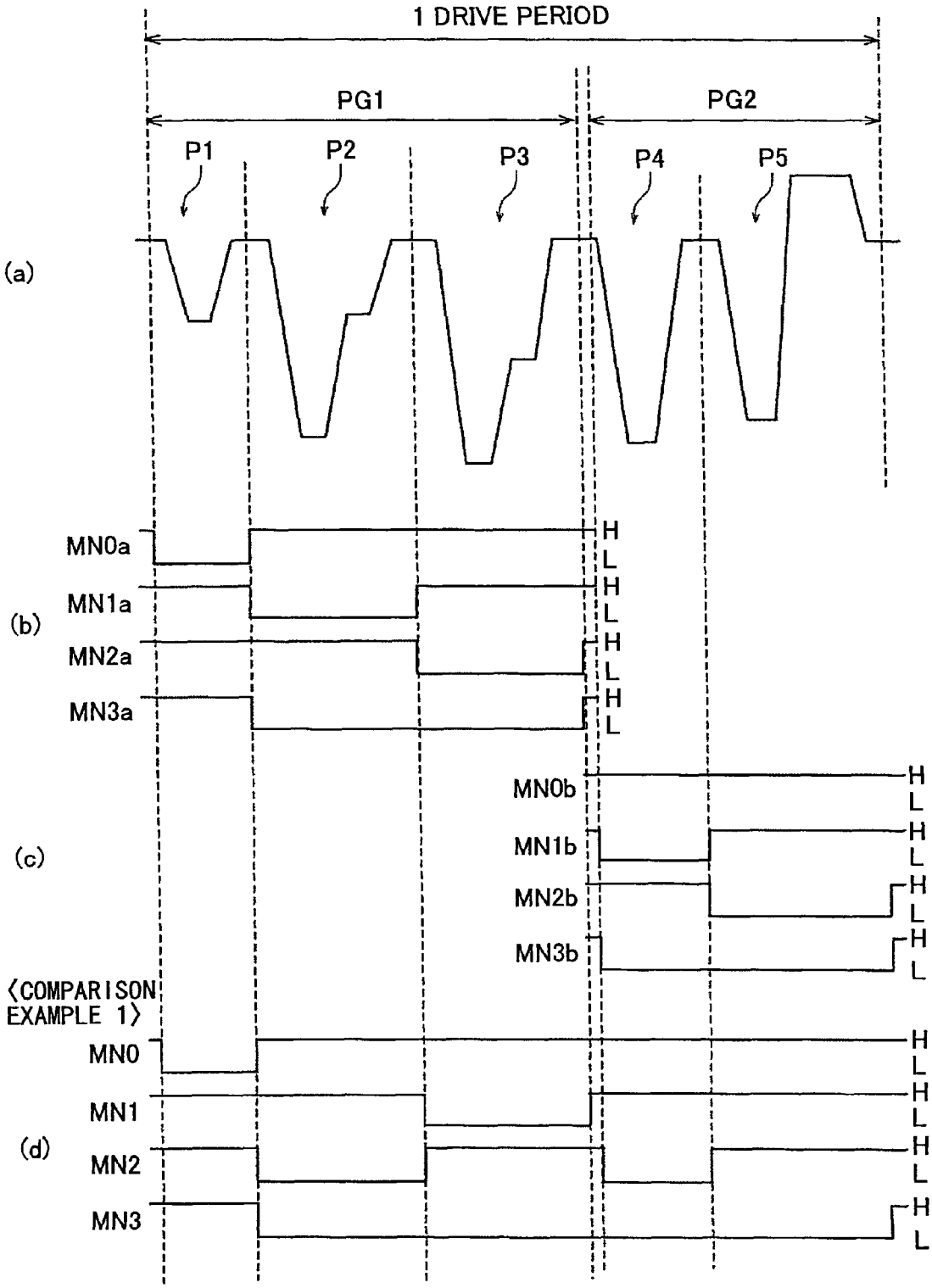
FIG. 8 is a diagram illustrating examples of a drive waveform generated and output by a drive waveform generating unit of the image forming apparatus and droplet control signals used for drive signal selection.

Referring to FIG. 8 (*a*), the first drive signal group PG1 generated and output by the drive waveform generating unit 401 includes a non-discharge drive pulse P1 having a waveform component that falls from a reference potential Ve, a waveform component that holds the potential after the fall, a waveform component that rises to the reference potential Ve without interruption; and discharge drive pulses P2 and P3 each having a waveform component that falls from the reference potential Ve, a waveform component that holds the potential after the fall, and a waveform component that rises to the reference potential Ve in plural phases.

In the following descriptions, 'non-discharge pulse' refers to a drive pulse (drive signal) that drives the piezoelectric element 121 to merely oscillate the meniscus of the recording liquid formed at the nozzle 104 without causing liquid droplets to be discharged from the nozzle 104, and 'discharge drive pulse' refers to a drive signal that drives the piezoelectric element 121 to discharge liquid droplets from the nozzle 104.

The second drive signal group PG2 that is successively generated and output after the first drive signal group PG1 includes a discharge drive pulse P4 having a waveform component that falls from the reference potential Ve, a waveform component that holds the potential after the fall, and a waveform component that rises to the reference potential Ve without interruption; and a drive pulse P5 having a waveform component that falls from the reference potential Ve, a waveform component that holds the potential after the fall, a waveform component that rises to a potential that is higher than the reference potential Ve, a waveform component that holds the potential after the rise, and a waveform component that falls to the reference potential Ve.

It is noted that the waveform component in which the potential V of the drive pulse falls from the reference potential Ve corresponds to a pulling waveform component that causes the piezoelectric element 121 to contract so that the volume of the liquid chamber 106 may increase. The waveform component that rises in potential from the falling edge corresponds to a pressurizing waveform component that causes the piezoelectric element 121 to expand so that the volume of the liquid chamber 106 may decrease.

With respect to the drive waveform as is described above, the data transfer unit 402 successively outputs the first droplet control signals MN0*a*-MN3*a* shown in FIG. 8 (*b*) for selecting the drive pulses P1-P3 making up the first drive signal group PG1 and the second droplet control signals MN0*b*-MN3*b* shown in FIG. 8 (*c*) for selecting the drive pulses P4 and P5 making up the second drive signal group PG2.

In the illustrated example of FIG. 8, the droplet control signal MN0*a* is for selecting the non-discharge drive pulse P1, the droplet control signal MN1*a* is for selecting the discharge drive pulse P2, the droplet control signal MN2*a* is for selecting the discharge drive pulse P3, and the droplet control signal MN3*a* is for selecting the discharge drive pulses P2 and P3. Also, the droplet control signal MN0*b* is for selecting neither the discharge drive pulse P4 nor the discharge drive pulse P5, the droplet control signal MN1*b* is for selecting the discharge drive pulse P4, the droplet control signal MN2*b* is for selecting the discharge drive pulse P5, the droplet control signal MN3*b* is for selecting the discharge drive pulses P4 and P5.

By using the above-described first and second droplet control signals MN0*a*-MN3*a* and MN0*b*-MN3*b*, liquid droplets may be discharged from the nozzle 104 in seven different sizes (when counting 'non-discharge' as a liquid droplet with zero liquid discharge amount) as is illustrated in FIG. 9, for example.

According to the illustrated example of FIG. 9, by supplying the droplet control signal MN0*a* and the droplet control signal MN0*b*, only the drive pulse P1 of the first drive signal group PG1 is selected and supplied to the liquid discharge head so that no liquid droplet is discharged (i.e., liquid droplet with a liquid discharge amount of 0 pl).

By supplying the droplet control signals MN2*a* and MN0*b*, only the drive pulse P3 of the first drive signal group PG1 is selected and supplied to the liquid discharge head so that a liquid droplet with a liquid discharge amount of 3 pl is discharged. By supplying the droplet control signals MN0*a* and MN1*b*, only the drive pulse P4 of the second drive signal group PG2 is selected and supplied to the liquid discharge head so that a liquid droplet with a liquid discharge amount of 4 pl is discharged. By supplying the droplet control signals MN0*a* and MN2*b*, only the drive pulse P5 of the second drive signal group PG2 is selected and supplied to the liquid discharge head so that a liquid droplet with a liquid discharge amount of 5 pl is discharged.

By supplying the droplet control signals MN1*a* and MN1*b*, the drive pulse P2 of the first drive signal group PG1 and the drive pulse P4 of the second drive signal group PG2 are selected and supplied to the liquid discharge head so that a liquid droplet with a liquid discharge amount of 9 pl is discharged. By supplying the droplet control signals MN3*a* and MN1*b*, the drive pulses P2 and P3 of the first drive signal group PG1 and the drive pulse P4 of the second drive signal group PG2 are selected and supplied to the liquid discharge head so that a liquid droplet with a liquid discharge amount of 13 pl is discharged. By supplying the droplet control signals MN3*a* and MN3*b*, the drive pulses P2 and P3 of the first drive signal group PG1 and the drive pulses P4 and P5 of the second drive signal group PG2 are selected and supplied to the liquid discharge head so that a liquid droplet with a liquid discharge amount of 18 pl is discharged.

As can be appreciated from the above descriptions, by providing drive waveform generating means for generating and outputting a drive waveform including a first drive signal group and a second drive signal group each made up of one or more drive signals within one drive period, and means for successively outputting first control signals for controlling selection of drive signals of the first drive signal group and second control signals for controlling selection of drive signals of the second drive signal group within one drive period, the number of options for selecting the drive signals may be increased and liquid droplets in a wider variety of sizes may be discharged (i.e., the number of droplet types may be increased) without increasing the number of signal lines used for selecting the drive signals. Also, in one preferred embodiment, the drive signals (drive pulses) of the first drive signal group and the drive signals (drive pulses) of the second drive signal group may be arranged to have differing signal properties such as differing waveform components as in the above-described example.

In the following, a comparison example is described with reference to FIG. 8 (*d*). According to the comparison example 1 shown in FIG. 8 (*d*), the drive waveform of FIG. 8 (*a*) is perceived as one drive signal group and droplet control signals MN0-MN3 are used to select relevant drive signals of the drive waveform within one drive period.

In FIG. 8 (*d*), the droplet control signal MN0 is for selecting the drive pulse P1, the droplet control signal MN1 is for selecting the drive pulse P3, the droplet control signal MN2 is for selecting the drive pulses P2 and P4, and the droplet control signal MN3 is for selecting the drive pulses P2, P3, P4, and P5. In this case, as is shown in FIG. 10, by supplying the droplet control signal MN0, only the drive pulse P1 is selected and supplied to the liquid discharge head so that no liquid droplet is discharged (liquid droplet with a liquid discharge amount of 0 pl). By supplying the droplet control signal MN1, only the drive pulse P3 is selected and supplied to the liquid discharge head so that a liquid droplet with a liquid discharge amount of 3 pl is discharged. By supplying the droplet control signal MN2, the drive pulses P2 and P4 are selected and supplied to the liquid discharge head so that a liquid droplet with a liquid discharge amount of 9 pl is discharged. By supplying the droplet control signal MN3, the drive pulses P2-P5 are selected and supplied to the liquid discharge head so that a liquid droplet with a liquid discharge amount of 18 pl is discharged.

As can be appreciated from the above descriptions, in the comparison example 1, liquid droplets may be discharged in only four different sizes, namely, non-discharge, small droplet (3 pl), medium droplet (9 pl), and large droplet (18 pl) using the four droplet control signals (two-bit signals) MN0-MN3 to select the drive pulses P1-P5 making up the drive waveform shown in FIG. 8 (*a*).

On the other hand, according to the above-described embodiment of the present invention, four droplet control signals (two-bit signals) are transferred two times within one drive period so that four different combinations (four gray levels) may be obtained for the first drive signal group PG1 and four different combinations (four gray levels) may be obtained for the second drive signal group to thereby enable liquid droplets to be discharged in seven different sizes using different combinations of the first and second droplet control signals as is illustrated in FIG. 9, for example.

In this way, provided with the same number of signal lines (bit number), the number of droplet types (sizes) that may be discharged in the present embodiment may be increased with respect to the comparison example 1. In other words, liquid droplets in a variety of different sizes may be discharged with a relatively simple configuration according to the present embodiment.

Also, in one preferred embodiment, the moving speeds of the droplets to be discharged by the drive signals may be adjusted so that when a dot is to be formed by discharging plural liquid droplets, the plural liquid droplets may be merged in midair to land on a recording medium as one droplet. In this way, a clearly defined dot may be formed, for example. Particularly, in the case of discharging the largest droplet, a well spread out and clearly defined dot may be formed by merging plural droplets in midair so that the droplets land as one droplet. In other embodiments, instead of merging the droplets in midair, plural droplets that are to form one dot may be arranged to land at substantially the same position of a recording medium, for example.

In discharging the largest droplet, by using a combination of the drive signal(s) of the first drive signal group and the drive signal(s) of the second signal group rather than using drive signals of only one of the drive signal groups, the length of one drive period may be reduced in relativity, that is, the drive frequency may be increased.

Also, in discharging the largest droplet, by using all of the drive signals used for discharging liquid droplets (discharge drive pulses), the length of one drive period may be reduced compared to the case of not using all the discharge drive pulses so that the drive frequency may be increased.

In the following, another set of examples of a drive waveform output by the drive waveform generating unit 401 and the droplet control signals output by the data transfer unit 402 is described with reference to FIGS. 11 and 12.

Figure 11:
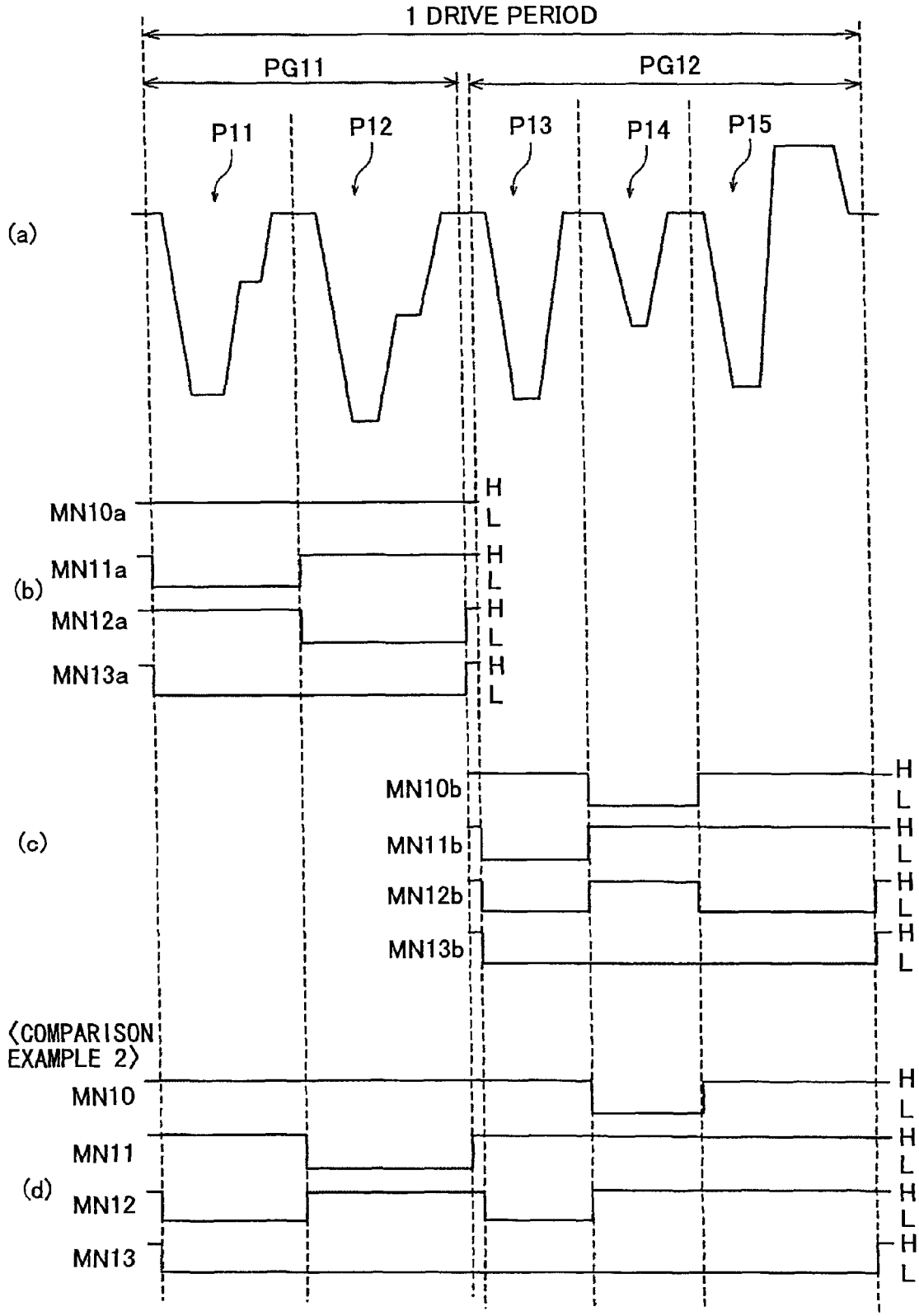
FIG. 11 is a diagram illustrating another set of examples of a drive waveform generated and output by the drive waveform generating unit and droplet control signals used for drive signal selection.

As is shown in FIG. 11 (*a*), in the present example, a first drive signal group PG11 that is generated and output by the drive waveform generating unit 401 includes a discharge drive pulse P11 having a waveform component that falls from the reference potential Ve, a waveform component that holds the potential after the fall, and a waveform component that rises to the reference potential Ve in plural phases; and a discharge drive pulse P12 having a waveform component that falls from the reference voltage Ve, a waveform component that holds the potential after the fall, and a waveform component that rises to the reference potential Ve in plural phases.

A second drive signal group PG12 that is generated and output following the first drive signal group PG11 includes a discharge drive pulse P13 having a waveform component that falls from the reference potential Ve, a waveform component that holds the potential after the fall, and a waveform component that rises to the reference potential Ve without interruption; a non-discharge drive pulse P14 having a waveform component that falls from the reference voltage Ve, a waveform component that holds the potential after the fall, and a waveform component that rises to the reference potential Ve without interruption; and a drive pulse P15 having a waveform component that falls from the reference voltage Ve, a waveform component that holds the potential after the fall, a waveform component that rises to a potential that is higher than the reference potential Ve without interruption, a waveform component that holds the potential after the rise, and a waveform component that falls to the reference potential Ve.

With respect to the drive waveform as is described above, the data transfer unit 402 successively outputs first droplet control signals MN10*a*-MN13*a* shown in FIG. 11 (*b*) for selecting the drive pulses P11 and P12 making up the first drive signal group PG11 and second droplet control signals MN10*b*-MN13*b* shown in FIG. 11 (*c*) for selecting the drive pulses P13-P15 making up the second drive signal group PG12.

In the illustrated example of FIG. 11, the droplet control signal MN10*a* is for selecting neither the drive pulse P11 nor the drive pulse P12, the droplet control signal MN11*a* is for selecting the discharge drive pulse P11, the droplet control signal MN12*a* is for selecting the discharge drive pulse P3, and the droplet control signal MN13*a* is for selecting the discharge drive pulses P11 and P12. Also, the droplet control signal MN10*b* is for selecting the non-discharge drive pulse P14, the droplet control signal MN11*b* is for selecting the discharge drive pulse P13, the droplet control signal MN12*b* is for selecting the discharge drive pulses P13 and P15, the droplet control signal MN13*b* is for selecting the discharge drive pulse P13, the non-discharge pulse P14, and the discharge pulse P15.

By using the above-described first and second droplet control signals MN10*a*-MN13*a* and MN10*b*-MN13*b*, liquid droplets may be discharged from the nozzle 104 in eight different sizes (when counting 'non-discharge' as a liquid droplet with zero liquid discharge amount) as is illustrated in FIG. 12, for example.

According to the illustrated example of FIG. 12, by supplying the droplet control signal MN10*a* and the droplet control signal MN10*b*, only the non-discharge drive pulse P14 of the second drive signal group PG12 is selected and supplied to the liquid discharge head so that no liquid droplet is discharged (i.e., liquid droplet with a liquid discharge amount of 0 pl).

By supplying the droplet control signals MN12*a* and MN10*b*, the drive pulse P12 of the first drive signal group PG11 and the non-discharge drive pulse P14 are selected and supplied to the liquid discharge head so that a liquid droplet with a liquid discharge amount of 3 pl is discharged. By supplying the droplet control signals MN10*a* and MN11*b*, only the drive pulse P13 of the second drive signal group PG12 is selected and supplied to the liquid discharge head so that a liquid droplet with a liquid discharge amount of 4 pl is discharged. By supplying the droplet control signals MN11*a* and MN11*b*, the drive pulse P11 of the first drive signal group PG11 and the drive pulse P13 of the second drive signal group PG12 are selected and supplied to the liquid discharge head so that a liquid droplet with a liquid discharge amount of 9 pl is discharged.

By supplying the droplet control signals MN13*a* and MN11*b*, the drive pulses P11 and P12 of the first drive signal group PG11 and the drive pulse P13 of the second drive signal group PG12 are selected and supplied to the liquid discharge head so that a liquid droplet with a liquid discharge amount of 13 pl is discharged. By supplying the droplet control signals MN11*a* and MN12*b*, the drive pulse P11 of the first drive signal group PG11 and the drive pulses P13 and P15 of the second drive signal group PG12 are selected and supplied to the liquid discharge head so that a liquid droplet with a liquid discharge amount of 15 pl is discharged. By supplying the droplet control signals MN13*a* and MN12*b*, the drive pulses P11 and P12 of the first drive signal group PG11 and the drive pulses P13 and P15 of the second drive signal group PG12 are selected and supplied to the liquid discharge head so that a liquid droplet with a liquid discharge amount of 18 pl is discharged. By supplying the droplet control signals MN13*a* and MN 13*b*, the drive pulses P11 and P12 of the first drive signal group PG11 and the discharge drive pulse P13, the non-discharge drive pulse P14, and the discharge drive pulse P15 of the second drive signal group PG12 are selected so that a liquid droplet with a liquid discharge amount of 21 pl is discharged.

In the following, a comparison example is described with reference to FIG. 11 (*d*). According to the comparison example 2 shown in FIG. 11 (*d*), the drive waveform of FIG. 11 (*a*) is perceived as one drive signal group and droplet control signals MN10-MN13 are used to select relevant drive signals of the drive waveform within one drive period.

In FIG. 11 (*d*), the droplet control signal MN10 is for selecting the non-discharge drive pulse P14, the droplet control signal MN11 is for selecting the drive pulse P12, the droplet control signal MN12 is for selecting the drive pulses P11 and P13, and the droplet control signal MN13 is for selecting the drive pulses P11-P15. In this case, as is shown in FIG. 13, by supplying the droplet control signal MN10, only the non-discharge drive pulse P14 is selected and supplied to the liquid discharge head so that no liquid droplet is discharged (liquid droplet with a liquid discharge amount of 0 pl). By supplying the droplet control signal MN11, only the drive pulse P12 is selected and supplied to the liquid discharge head so that a liquid droplet with a liquid discharge amount of 3 pl is discharged. By supplying the droplet control signal MN12, the drive pulse P11 is selected and supplied to the liquid discharge head so that a liquid droplet with a liquid discharge amount of 9 pl is discharged. By supplying the droplet control signal MN13, the drive pulses P11-P15 are selected and supplied to the liquid discharge head so that a liquid droplet with a liquid discharge amount of 21 pl is discharged.

As can be appreciated from the above descriptions, in the comparison example 2, liquid droplets may be discharged in only four different sizes, namely, non-discharge, small droplet (3 pl), medium droplet (9 pl), and large droplet (18 pl) using the four droplet control signals (two-bit signals) MN10-MN13 to select the drive pulses P11-P15 making up the drive waveform shown in FIG. 11 (*a*).

On the other hand, according to the above-described embodiment of the present invention, four droplet control signals (two-bit signals) are transferred two times within one drive period so that four different combinations (four gray levels) may be obtained for the first drive signal group PG1 and four different combinations (four gray levels) may be obtained for the second drive signal group to thereby enable liquid droplets to be discharged in eight different sizes using different combinations of the first and second droplet control signals as is illustrated in FIG. 12, for example.

In this way, provided with the same number of signal lines (bit number), the number of droplet types (sizes) that may be discharged in the present embodiment may be increased with respect to the comparison example 1. In other words, liquid droplets in a variety of different sizes may be discharged with a relatively simple configuration according to the present embodiment.

Also, in discharging the largest droplet, by using all of the drive signals (non-discharge pulse and discharge drive pulses), the length of one drive period may be reduced compared to the case of not using all the drive pulses so that the drive frequency may be increased.

In the following, exemplary operations for switching a drive signal selection scheme depending on the printing mode being implemented are described with reference to the flowcharts shown in FIGS. 14 and 15.

Figure 14:
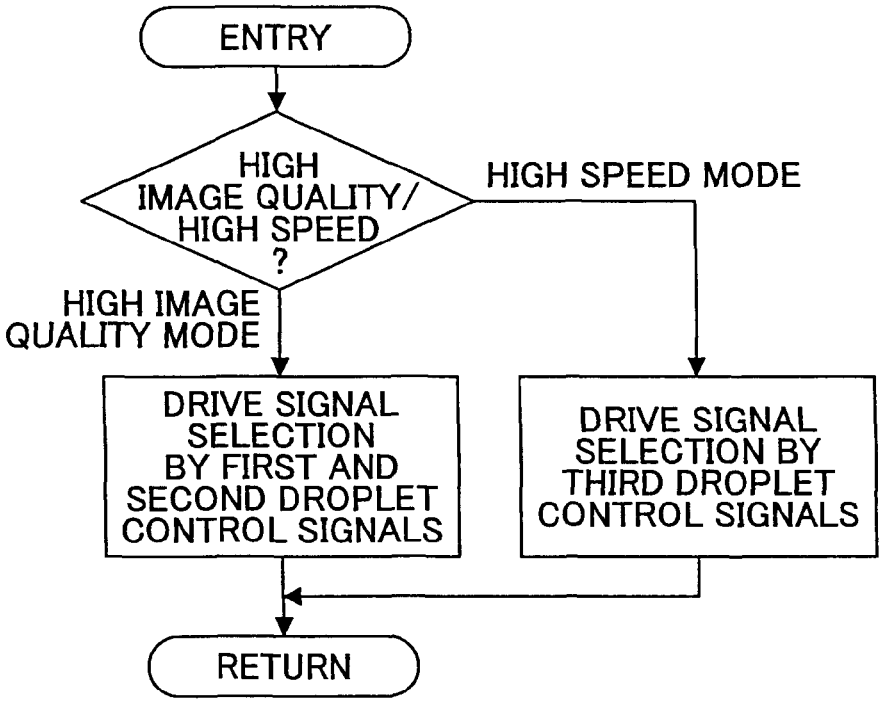
FIG. 14 is a flowchart illustrating exemplary operations for switching a drive signal selection scheme depending on the printing mode being implemented.

In a first example as is illustrated in FIG. 14, a determination is made as to whether the printing mode corresponds to a high image quality mode that prioritizes image quality over printing speed or a high speed mode that prioritizes printing speed over image quality. If the high image quality mode is implemented, operations are controlled to use the above-described first droplet control signals MN0*a*-MN3*a* (or MN10*a*-MN13*a*) and second droplet control signals MN0*b*-MN3*b* (or MN10*b*-MN13*b*) to select drive pulses for discharging liquid droplets. If the high speed mode is implemented, operations may be controlled to use the droplet control signals MN0-MN3 or MN10-MN13 (referred to as 'third droplet control signals' hereinafter) of the above-described comparison example 1 or 2 to select the drive pulses (drive signals) for discharging liquid droplets, for example. According to the present example, in high image quality mode, an image may be formed by multi-level dots of five or more levels, and in high speed mode, an image may be formed by four-level dots.

By controlling operations so that drive pulses are selected using the first droplet control signals and the second droplet control signals in the high image quality mode, whereas drive pulses are selected using the third droplet control signals that only requires one-time data transfer in the high speed mode, a high image quality image may be formed while still accommodating the demands for high speed printing.

Figure 15:
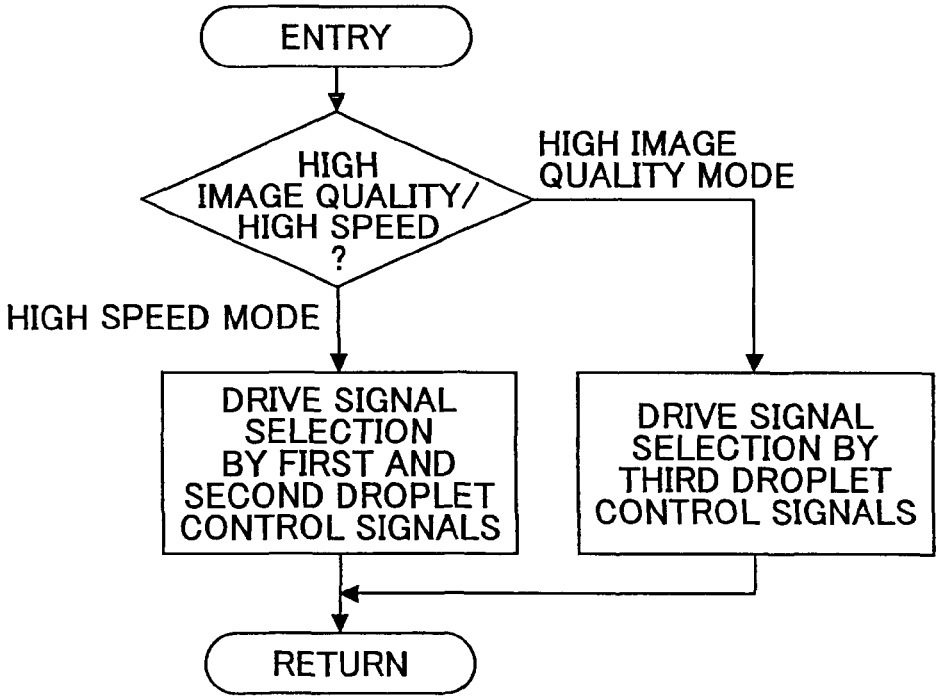
FIG. 15 is a flowchart illustrating another set of exemplary operations for switching a drive signal selection scheme depending on the printing mode being implemented.

In the second example as is illustrated in FIG. 15, a determination is made as to whether the current printing mode corresponds to a high image quality mode that prioritizes image quality over printing speed or a high speed mode that prioritizes printing speed over image quality. If the high image quality mode is implemented, operations are controlled to use the third droplet control signals to select drive signals for discharging liquid droplets, and if the high speed mode is implemented, operations are controlled to use the first droplet control signals and the second droplet control signals to select the drive signals for discharging liquid droplets. In this case, an image is formed by four-level dots in the high image quality mode, and an image may be formed by multi-level dots of five or more levels in the high speed mode.

By controlling operations so that drive pulses are selected using the third droplet control signals in the high image quality mode whereas drive pulses are selected using the first droplet control signals and the second droplet control signals in the high speed mode, a high quality image may still be formed in the high speed mode even when the scanning resolution is decreased by using multi-level dots. In this example, since the resolution in the high speed mode is arranged to be lower than that used in the high image quality mode, the drive waveform itself may preferably be switched to a different drive waveform for discharging greater amounts of liquid, for example.

In the following, exemplary operations for switching a drive signal selection scheme depending on the type of paper used are described with reference to the flowchart shown in FIG. 16.

Figure 16:
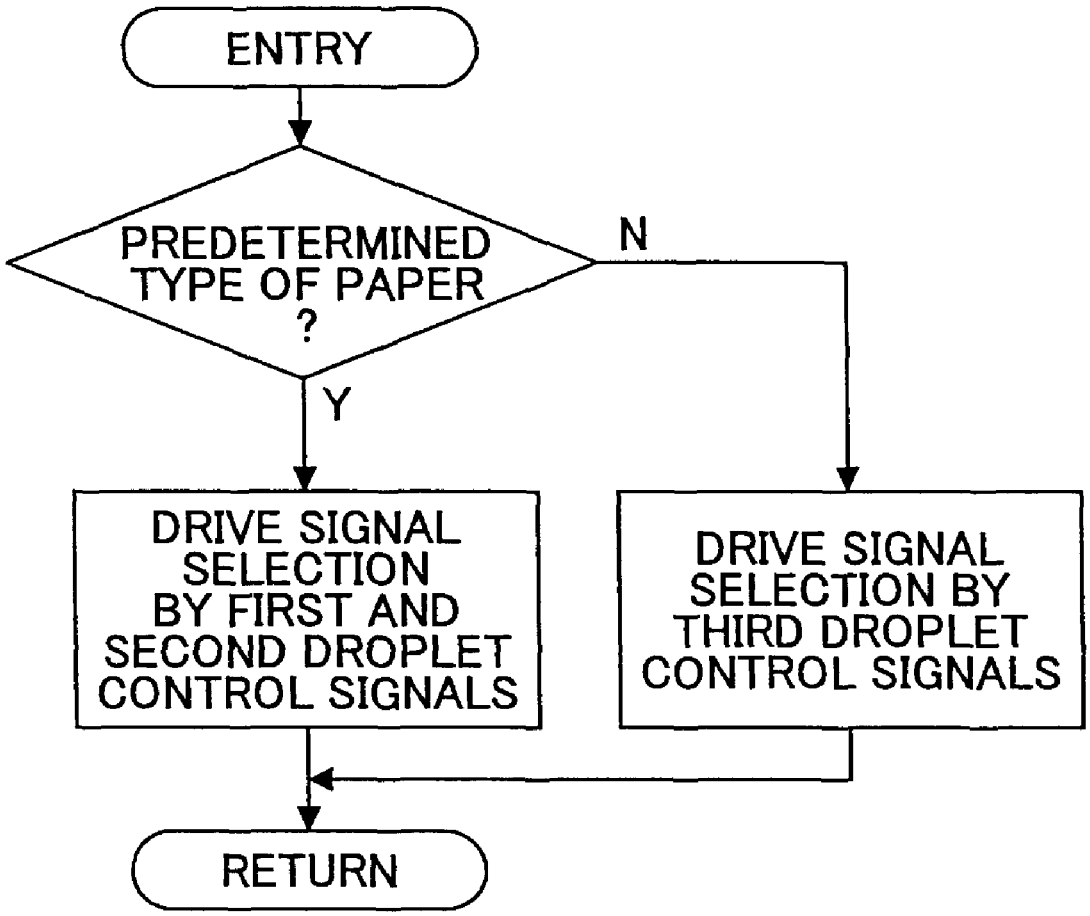
FIG. 16 is a flowchart illustrating exemplary operations for switching a drive signal selection scheme depending on the type of paper being used.

In the illustrated example of FIG. 16, the type of the paper currently being used is determined, and if the paper corresponds to a predetermined type of paper, operations are controlled to use the above-described first droplet control signals MN0*a*-MN3*a* (or MN10*a*-MN13*a*) and the second droplet control signals MN0*b*-MN3*b* (or MN10*b*-MN13*b*) to select the drive pulses (drive signals) for discharging liquid droplets, and if the paper does not correspond to the predetermined type of paper, operations may be controlled to use the third droplet control signals MN0-MN3 or MN10-MN13 of the comparison example 1 or 2 to select the drive pulses (drive signals) for discharging liquid droplets, for example.

According to the present embodiment, operations may be switched between forming an image with multi-level dots of five or more levels and forming an image with four-level dots depending on the type of paper being used.

In the following, examples of a drive waveform including an idle discharge drive pulse that is output by the drive waveform generating unit 401 and droplet control signals output by the data transfer unit 402 are described with reference to FIGS. 17 and 18.

Figure 17:
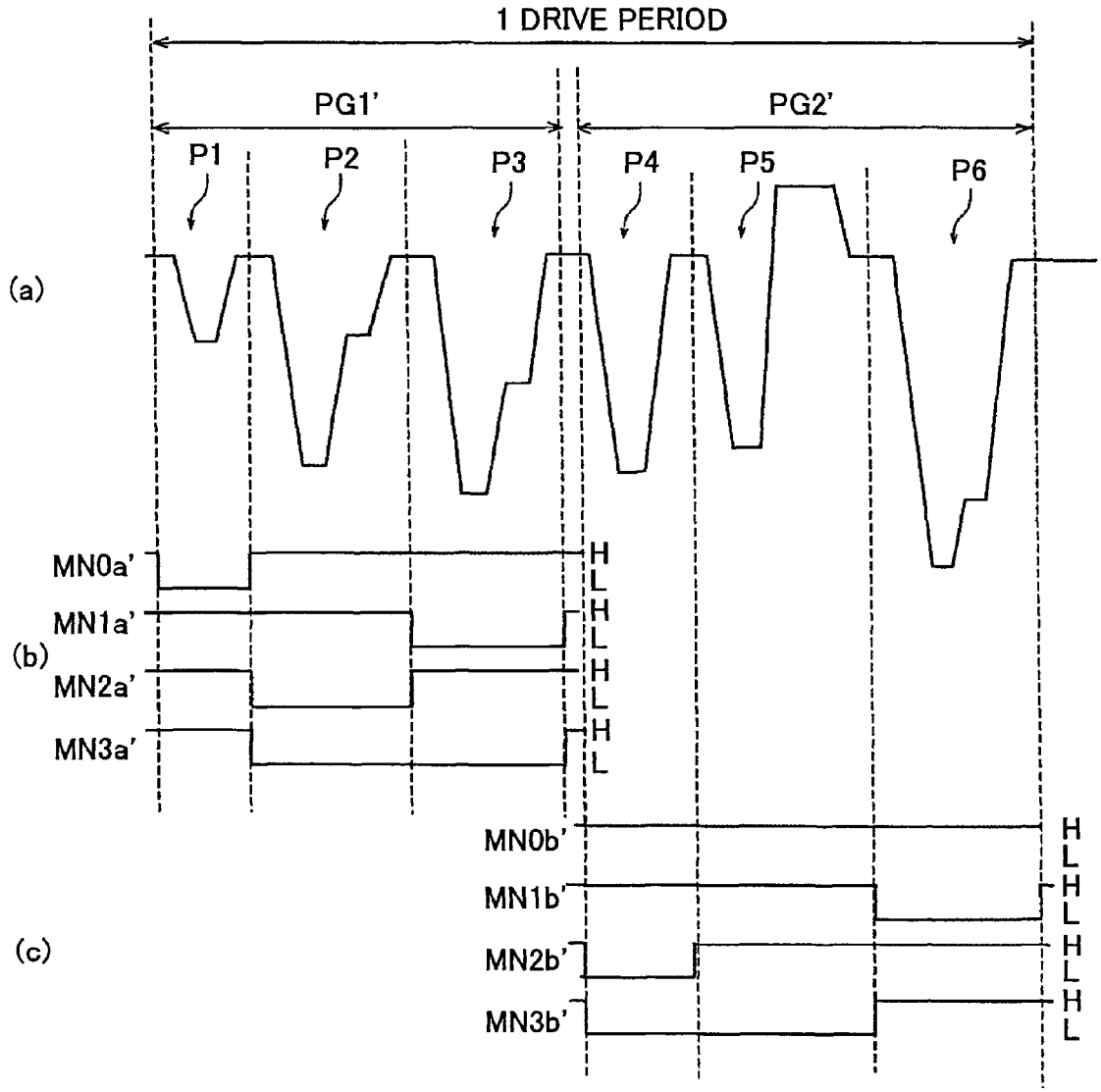
FIG. 17 is a diagram illustrating examples of a drive waveform including an idle discharge drive pulse that is generated and output by the drive waveform generating unit and droplet control signals used for drive signal selection.

The waveform of the present example as is shown in FIG. 17 (*a*) includes a drive pulse P6 in addition to drive pulses P1-P5 that are substantially identical to those shown in FIG. 8 (*a*). Specifically, the drive pulse P6 is added after the drive pulse P5 of the second drive signal group PG2 of FIG. 8 (*a*) to form a second drive signal group PG2'. It is noted that a first drive signal group PG1' of the present example may be substantially identical to the first drive signal group PG1 of FIG. 8(*a*). First droplet control signals MN0*a*'-MN3*a*' shown in FIG. 17 (*b*) are for selecting the drive pulses P1-P3 of the first drive signal group PG1', and second droplet control signals MN0*b*'-MN3*b*' shown in FIG. 17 (*c*) are for selecting the drive pulses P4-P6 of the second drive signal group PG2'. Specifically, the droplet control signal MN0*a*' is for selecting the non-discharge drive pulse P1, the droplet control signal MN1*a*' is for selecting the discharge drive pulse P3, the droplet control signal MN2*a*' is for selecting the discharge drive pulses P2 and P3, and the droplet control signal MN3*a*' is for selecting the non-discharge drive pulse P1 and the discharge drive pulses P2 and P3. Also, the droplet control signal MN0*b*' is for selecting the neither the discharge drive pulses P4, P5, nor the idle discharge drive pulse P6, the droplet control signal MN1*b*' is for selecting the idle discharge drive pulse P6, the droplet control signal MN2*b*' is for selecting the discharge drive pulse P4, and the droplet control signal MN3*b*' is for the discharge drive pulses P4 and P5.

By using the above-described first and second droplet control signals MN0*a*'-MN3*a*' and MN0*b*'-MN3*b*', liquid droplets may be discharged in eight different sizes (counting non-discharge as a liquid droplet with zero discharge amount) as is illustrated in FIG. 18, for example.

According to the illustrated example of FIG. 18, by supplying the droplet control signals MN0*a*' and MN0*b*', only the non-discharge drive pulse P1 of the first drive signal group PG1' is selected and supplied to the liquid discharge head so that no liquid droplet is discharged (liquid droplet with a liquid droplet amount of 0 pl).

By supplying the droplet control signals MN1*a*' and MN0*b*', only the discharge drive pulse P3 of the first drive signal group PG1' is selected and supplied to the liquid discharge head so that a liquid droplet with a liquid discharge amount of 3 pl is discharged. By supplying the droplet control signals MN0*a*' and MN2*b*', only the discharge drive pulse P4 of the second drive signal group PG2' is selected and supplied to the liquid discharge head so that a liquid droplet with a liquid discharge amount of 5 pl is discharged. By supplying the droplet control signals MN2*a*' and MN2*b*', the discharge drive pulse P2 of the first drive signal group PG1' and the discharge drive pulse P4 of the second drive signal group PG2' are selected and supplied to the liquid discharge head so that a liquid droplet with a liquid discharge amount of 9 pl is discharged.

By supplying the droplet control signals MN2*a*' and MN3*b*', the discharge drive pulse P2 of the first drive signal group PG1' and the discharge drive pulses P4 and P5 of the second drive signal group PG2' are selected and supplied to the liquid discharge head so that a liquid droplet with a liquid discharge amount of 13 pl is discharged. By supplying the droplet control signals MN3*a*' and MN2*b*', the drive pulses P1, P2, and P3 of the first drive signal group PG1' and the discharge drive pulse P4 of the second drive signal group PG2' are selected and supplied to the liquid discharge head so that a liquid droplet with a liquid discharge amount of 18 pl is discharged. By supplying the droplet control signals MN3*a*' and MN3*b*', the drive pulses P1, P2, and P3 of the first drive signal group PG1' and the discharge drive pulses P4 and P5 of the second drive signal group PG2' are selected and supplied to the liquid discharge head so that a liquid droplet with a liquid discharge amount of 21 pl is discharged.

By supplying the droplet control signals MN0*a*' and MN1*b*', the non-discharge drive pulse P1 of the first drive signal group PG1 and the idle discharge drive pulse P6 of the second drive signal group PG2' are selected and supplied to the liquid discharge head so that a liquid droplet with a liquid discharge amount of less than 2 pl is discharged. It is noted that dots may not be visually recognized even when idle discharge is performed on paper if the liquid discharge amount of the discharged droplet used for the idle discharge is less than 2 pl. In view of such circumstances, according to the present embodiment, idle discharge operations for restoring the liquid discharge head may be performed on paper so that the process time required for the idle discharge operations may be reduced compared to a case of performing idle discharge operations at a non-printing area, for example.

In the following, another set of examples of a drive waveform including an idle discharge drive pulse that is output by the waveform generating unit 401 and droplet control signals output by the data transfer unit 402 is described with reference to FIGS. 19 and 20.

Figure 19:
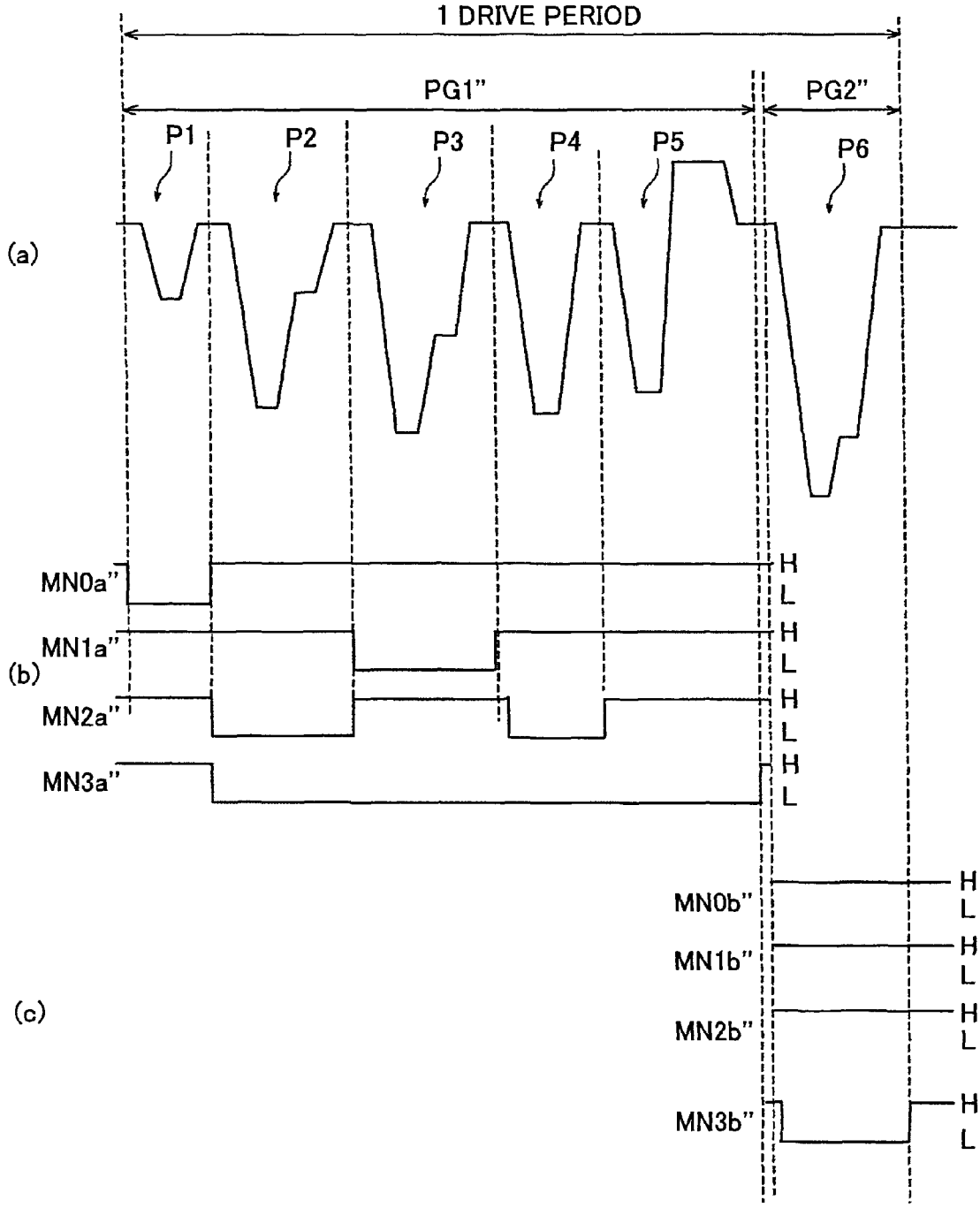
FIG. 19 is a diagram illustrating another set of examples of a drive waveform including an idle discharge drive pulse that is generated and output by the drive waveform generating unit and droplet control signals used for drive signal selection.

The drive waveform according to the present example as is illustrated in FIG. 19 (*a*) includes pulses P1-P6 that are substantially identical to those shown in FIG. 17 (*a*); however, in the present example, the pulses P1-P5 are grouped as a first drive signal group PG1" and the pulse P6 is grouped as a second drive signal group PG2". First droplet control signals MN0*a*'-MN3*a*' shown in FIG. 19 (*b*) are for selecting the drive pulses P1-P5 of the first drive signal group PG1" and second droplet control signals MN0*b*'-MN3*b*' shown in FIG. 19 (*c*) are for selecting the drive pulse P6. Specifically, the droplet control signal MN0*a*" is for selecting the non-discharge drive pulse P1, the droplet control signal MN1*a*" is for selecting the discharge drive pulse P3, the droplet control signal MN2*a*" is for selecting the discharge drive pulses P2 and P4, and the droplet control signal MN3*a*" is for selecting the discharge drive pulses P2-P5. Also, the droplet control signals MN0*b*", MN1*b*", and MN2*b*" are for not selecting the idle discharge drive pulse P6, and the droplet control signal MN3*b*" is for selecting the idle discharge drive pulse P6.

By using the above-described first and second droplet control signals MN0*a*"-MN3*a*" and MN0*b*"-MN3*b*", liquid droplets may be discharged in five different sizes (counting non-discharge as a liquid droplet with zero liquid discharge amount) as is illustrated in FIG. 20, for example.

According to the illustrated example of FIG. 20, by supplying the droplet control signals MN0*a*" and MN0*b*", only the non-discharge drive pulse P1 of the first drive signal group PG1" is selected and supplied to the liquid discharge head so that no liquid droplet is discharged (liquid droplet with a liquid droplet amount of 0 pl).

By supplying the droplet control signals MN1*a*" and MN0*b*", only the discharge drive pulse P3 of the first drive signal group PG1" is selected and supplied to the liquid discharge head so that a liquid droplet with a liquid discharge amount of 3 pl is discharged. By supplying the droplet control signals MN2*a*" and MN0*b*", the discharge drive pulses P2 and P4 of the second drive signal group PG2" are selected and supplied to the liquid discharge head so that a liquid droplet with a liquid discharge amount of 9 pl is discharged. By supplying the droplet control signals MN3*a*" and MN0*b*", the discharge drive pulses P2-P5 of the first drive signal group PG1" are selected and supplied to the liquid discharge head so that a liquid droplet with a liquid discharge amount of 21 pl is discharged.

By supplying the droplet control signals MN0*a*" and MN3*b*", the non-discharge pulse P1 of the first drive signal group PG1" and the idle discharge pulse P6 of the second drive signal group PG2" are selected and supplied to the liquid discharge head so that a liquid droplet with a liquid discharge amount of less than 2 pl is discharged. As is described above, dots may not be recognizable even when idle discharge operations are performed on paper if the liquid discharge amount of the discharged liquid droplet is less than 2 pl. In view of such circumstances, the present example enables idle discharge operations to be performed on paper for restoring the liquid discharge head so that the process time required for the idle discharge operations may be reduced compared to a case where idle discharge operations are performed at a non-printing area, for example.

In the following, an image forming apparatus according to another embodiment of the present invention is described with reference to FIG. 21.

Figure 21:
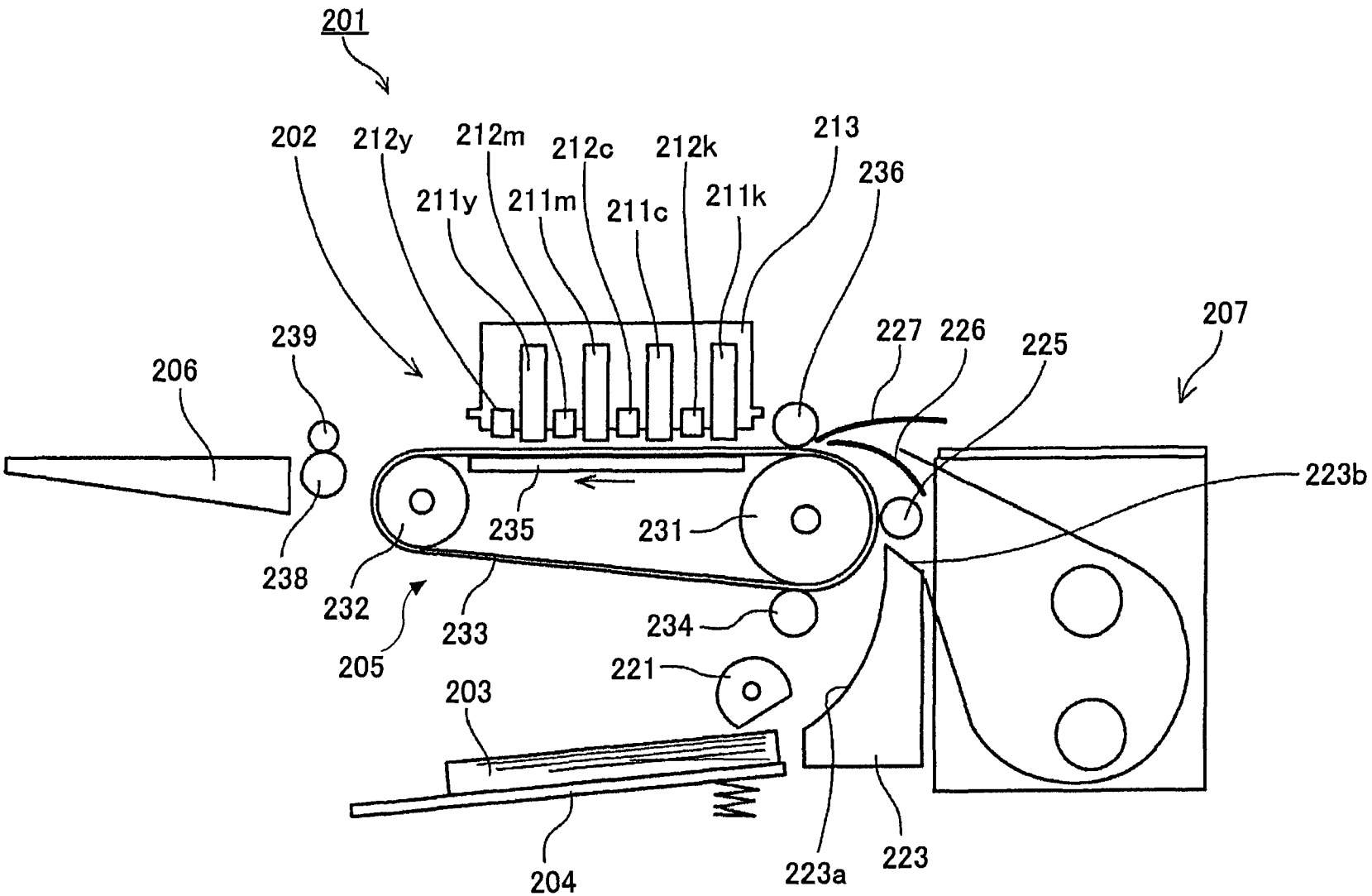
FIG. 21 is a diagram showing another exemplary configuration of an image forming apparatus according to an embodiment of the present invention.

The illustrated image forming apparatus of FIG. 21 includes an apparatus main frame 201 that accommodates an image forming unit 202 and a conveying mechanism 205, for example, a paper feed tray 204 disposed at the lower side of the apparatus main frame 201, a paper delivery tray 206 disposed at one side of the apparatus main frame 201, and a detachable dual-side printing unit 207 disposed at another side of the apparatus main frame 201. The paper feed tray 204 stacks plural sheets of recording media (paper) 203 that are to be fed into the apparatus main frame 201. Paper 203 that is fed into the apparatus main frame 201 is conveyed by the conveying mechanism 205 while the image forming unit 202 forms (records) a predetermined image on the paper 203 after which the paper 203 with the predetermined image formed thereon may be delivered to the paper delivery tray 206, for example.

In the case of performing dual-side printing, after completing printing on one side (front side) of the paper 203, the conveying mechanism 205 conveys the paper 203 in a reverse conveying direction to feed the paper 203 into the dual-side printing unit 207 at which the paper 203 is turned over to the other side (back side) and re-fed to the conveying mechanism 205 so that an image may be formed on the other side after which the paper 203 may be delivered to the paper delivery tray 206.

The image forming unit 202 includes four full line recording heads 211*k*, 211*c*, 211*m*, and 211*y* (simply referred to as 'recording head 211' when color distinctions are not made) as embodiments of liquid discharge heads that respectively discharge droplets of liquid in colors black (K), cyan (C), magenta (M), and yellow (Y), for example. The recording heads 211 are loaded in a head holder 213 in a manner such that their nozzle surfaces having nozzles for discharging liquid droplets face downward.

The printing unit 202 also includes maintenance/restoration mechanisms 212*k*, 212*c*, 212*m*, and 212*y* (simply referred to as 'maintenance/restoration mechanism 212' when color distinctions are not made) for maintaining and restoring the performance of the recording heads 211*k*, 211*c*, 211*m*, and 211*y*, respectively. When recording head maintenance operations such as purge operations and wiping operations are performed, the recording heads 211 and the maintenance/restoration mechanisms 212 are moved relative to each other so that the capping members and/or other relevant components of the maintenance/restoration mechanisms 212 may face the nozzle surfaces of the recording heads 211.

It is noted that in the illustrated example, the recording heads 211 are arranged in the color order, yellow, magenta, cyan, and black from the upstream side of the paper conveying direction so that liquid droplets may be discharged on the paper 203 in this order; however, the color arrangement and the number of colors used are not limited to this example. Also, the line heads may be configured as one or more heads having plural nozzle rows for discharging liquid droplets of different colors arranged at predetermined intervals, for example. Further, a head and a recording liquid cartridge for supplying recording liquid to the head may be an integrated unit or separate units, for example. The line heads may also be configured as two heads arranged at different levels on a straight line, for example.

The paper 203 stacked on the paper feed tray 204 may be fed into the apparatus main frame 201 one sheet at a time by a paper feed roller 221 and a separating pad (not shown). The paper 203 fed in this manner is guided along a guide surface 223*b* of a conveying guide member 223 to be inserted between a resist roller 225 and a conveying belt 233. Then, the paper 203 is conveyed onto a conveying belt 233 of the conveying mechanism 205 via a guide member 226 at a predetermined timing.

The conveying guide member 223 also has a guide surface 223*b* for guiding the paper 203 that is output from the dual-side printing unit 207. Additionally, a guide member 227 is arranged near the entrance of the dual-side printing unit 207 for guiding the paper 203 that is conveyed by the conveying unit 205 in the reverse conveying direction.

The conveying mechanism 205 includes an endless conveying belt 233 that is arranged around a conveying roller (drive roller) 231 and a driven roller 232, a charge roller 234 for charging the conveying belt 233, a platen member 235 for maintaining the planarity of a portion of the conveying belt 233 facing the image forming unit 202, a press roller 236 for pressing the paper 203 conveyed by the conveying belt 233 toward the conveying roller 231, and other elements such as a cleaning roller (not shown) made of porous material as cleaning means for removing recording liquid (ink) adhered to the conveying belt 233.

Also, a paper delivery roller 238 and a spur 239 for delivering the paper 203 with a recorded image to the paper delivery tray 206 are arranged at the downstream side of the conveying mechanism 205.

In the image forming apparatus as is described above, the conveying belt 233 rotates in the direction indicated by the arrow shown in FIG. 21 and is positively charged by coming into contact with the charge roller 334 that is applied a high potential voltage. In this case, the charge voltage of the charge roller 234 may switch its polarity at predetermined time intervals to charge the conveying belt 233 at a predetermined charge pitch.

When the paper 203 is conveyed to the conveying belt 233 that is charged to a high potential, the interior of the paper 203 may be polarized and the charge having an opposite polarity with respect to the charge of the conveying belt 233 may be redistributed toward the surface of the paper 203 that is in contact with the conveying belt 233 so that the charge of the conveying belt 233 and the redistributed charge at the surface of the paper 203 may statically pull at each other. In this way, the paper 203 may be statically attracted to the conveying belt 233. By having the paper 203 statically attracted to the conveying belt 233 with a relatively strong force, warps and/or bumps formed at the paper 203 may be smoothed out to form a highly planar paper surface.

The paper 203 conveyed to the conveying belt 233 may be moved by the rotating movement of the conveying belt 233, and an image may be formed on the paper 203 by discharging liquid droplets from the recording heads 211. Then, the paper 203 with the image formed thereon may be delivered to the paper delivery tray 206 by the delivery roller 238.

As can be appreciated from the above descriptions, the image forming apparatus of the present example uses a liquid discharge apparatus according and embodiment of the present invention that includes one or more line heads as liquid discharge heads so that liquid droplets in a variety of sizes may be discharged with a relatively simple configuration and a high quality image may be formed even at a relatively low resolution. It is noted that when a line head is used as the liquid discharge head, the resolution with respect to the direction perpendicular to the recording medium conveying direction (nozzle alignment direction) is restricted by the nozzle pitch even when the printing speed is decreased. Accordingly, by enabling discharge of liquid droplets in a variety of different sizes as in the present example, image quality of a printed image may be improved even when the resolution is not increased.

It is noted that although printer configurations are described above as image forming apparatuses according to preferred embodiments of the present invention, the present invention may equally be applied to other types of image forming apparatuses such as a printer/fax/copier multifunction machine. Also, an image forming apparatus according to an embodiment of the present invention is not limited to using ink as the discharging liquid and may also use other types of recording liquids and fixing liquids, for example.

Although the present invention is shown and described with respect to certain preferred embodiments, it is obvious that equivalents and modifications will occur to others skilled in the art upon reading and understanding the specification. The present invention includes all such equivalents and modifications, and is limited only by the scope of the claims.

The present application is based on and claims the benefit of the earlier filing dates of Japanese Patent Application No. 2006-144538 filed on May 24, 2006, and Japanese Patent Application No. 2007-038598 filed on Feb. 19, 2007, the entire contents of which are hereby incorporated by reference.

The invention claimed is:

1. An image forming apparatus configured to form an image on a recording medium, the image forming apparatus comprising:

a liquid discharge apparatus that includes:

a liquid discharge head configured to discharge a plurality of types of liquid droplets;

a drive waveform generating unit configured to generate and output a drive waveform including a first drive signal group made up of one or more drive signals and a second drive signal group made up of one or more drive signals within one drive period;

a control signal output unit that outputs one of a plurality of first control signals for controlling selection of one or more drive signals of the first drive signal group and one of a plurality of second control signals for controlling selection of one or more drive signals of the second drive signal group, or one of a plurality of third control signals for controlling selection of one or more drive signals of the first drive signal group and the second drive signal group; and a drive unit that inputs the drive waveform, the one of the plurality of first control signals, and the one of the plurality of second control signals, or the one of the plurality of third control signal, selects one or more drive signals from the drive signals of the first drive signal group and the second drive signal group using the one of the plurality of first control signals and the one of the plurality of second control signals or the one of the plurality of third control signals, and supplies the selected drive signals to the liquid discharge head, wherein the selection of one or more drive signals of the first drive signal group and the second drive signal group using the one of the plurality of first control signals and the one of the plurality of second control signals or the one of the plurality of third control signals is performed depending on a printing mode, and the selection of one or more drive signals of the first drive signal group and the second drive signal group using the one of the plurality of first control signals and the one of the plurality of second control signals is performed when the printing mode corresponds to a high image quality mode that prioritizes image quality, the selection of one or more drive signals of the first drive signal group and the second drive signal group using the one of the plurality of third control signals is performed when the printing mode corresponds to a high speed mode that prioritizes printing speed.

2. The image forming apparatus as claimed in claim 1, wherein the selection of one or more drive signals of the first drive signal group and the second drive signal group using the one of the plurality of first control signals and the one of the plurality of second control signals is performed when the printing mode corresponds to a high speed mode that prioritizes printing speed.

3. The image forming apparatus as claimed in claim 1, wherein at least one of the first drive signal group and the second drive signal group includes an idle discharge drive signal for performing idle discharge operations on the recording medium.

4. The image forming apparatus as claimed in claim 1, wherein the liquid discharge head corresponds to a line head that has a plurality of nozzles for discharging the liquid droplets which nozzles are aligned along a width of the recording medium.

5. The image forming apparatus as claimed in claim 1, wherein signal properties of the drive signals of the first drive signal group differ from signal properties of the drive signals of the second drive signal group.

6. The image forming apparatus as claimed in claim 1, wherein a combination of at least one of the drive signals of the first drive signal group and at least one of the drive signals of the second drive signal group is selected by the drive unit upon forming a largest liquid droplet.

7. The image forming apparatus as claimed in claim 1, wherein a combination of the drive signals of the first drive signal group and one or more discharge drive signals of the drive signals of the second drive signal group is selected by the drive unit upon forming a largest liquid droplet.

8. The image forming apparatus as claimed in claim 1, wherein a combination of the drive signals of the first drive signal group and the drive signals of the second drive signal group is selected by the drive unit upon forming a largest liquid droplet.

9. The image forming apparatus as claimed in claim 1, wherein a plurality of droplets that are discharged by the selected one or more drive signals for forming a largest liquid droplet are merged into one droplet in midair.

10. The image forming apparatus as claimed in claim 1, wherein a plurality of droplets that are discharged by the selected one or more drive signals for forming a predetermined type of liquid droplet are merged in midair.

11. The image forming apparatus as claimed in claim 1, wherein a plurality of droplets that are discharged by the selected one or more drive signals are controlled to land at a same position.

* * * * *